US006657389B2

(12) United States Patent
Saitou et al.

(10) Patent No.: US 6,657,389 B2
(45) Date of Patent: Dec. 2, 2003

(54) GLOW DISCHARGE LAMP, ELECTRODE THEREOF AND LUMINAIRE

(75) Inventors: Akiko Saitou, Kanagawa-ken (JP); Shigeru Osawa, Kanagawa-ken (JP); Nobuhiro Tamura, Kanagawa-ken (JP); Noriyuki Hayama, Kanagawa-ken (JP); Yoshiyuki Matsunaga, Kanagawa-ken (JP); Takashi Yorifuji, Kanagawa-ken (JP); Mitsuru Shiozaki, Kanagawa-ken (JP); Masahiro Izumi, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 0 days.

(21) Appl. No.: 10/156,011

(22) Filed: May 29, 2002

(65) Prior Publication Data

US 2002/0185977 A1 Dec. 12, 2002

(30) Foreign Application Priority Data

| | | |
|---|---|---|
| May 29, 2001 | (JP) | P2001-161313 |
| May 29, 2001 | (JP) | P2001-161314 |
| Aug. 29, 2001 | (JP) | P2001-260172 |
| Aug. 31, 2001 | (JP) | P2001-264434 |
| Jan. 31, 2002 | (JP) | P2002-024812 |
| Feb. 28, 2002 | (JP) | P2002-054695 |
| Feb. 28, 2002 | (JP) | P2002-054696 |

(51) Int. Cl.[7] ..... H01J 17/02
(52) U.S. Cl. ..... 313/633; 313/491
(58) Field of Search ..... 313/491, 513, 313/630, 631, 633

(56) References Cited

U.S. PATENT DOCUMENTS 4,843,282 A * 6/1989 Barakitis et al. ..... 313/572

FOREIGN PATENT DOCUMENTS

| | | |
|---|---|---|
| JP | 54-64873 | 5/1979 |
| JP | 10-255724 | 9/1998 |
| WO | WO 98/09317 | 3/1998 |

* cited by examiner

*Primary Examiner*—Vip Patel
(74) *Attorney, Agent, or Firm*—Pillsbury Winthrop LLP

(57) ABSTRACT

A glow discharge lamp has a discharge vessel, a pair of electrodes mounted in the discharge vessel, ionizable filling which is principally made of rare gas and filled in the discharge vessel, and emissive material containing zinc alloy and provided on at least one of the electrodes.

19 Claims, 16 Drawing Sheets

GLOW DISCHARGE LAMP, ELECTRODE THEREOF AND LUMINAIRE

FIELD OF THE INVENTION

The present invention relates to a glow discharge lamp which is suitable as a glow starter for starting a fluorescent lamp or a hot-cathode fluorescent lamp to operate, a luminaire utilizing the glow discharge lamp and an electrode for a glow discharge lamp.

BACKGROUND OF THE INVENTION

A glow discharge lamp has been in heavy usage as a glow starter for starting a discharge lamp such as a cold-cathode discharge lamp, a hot-cathode fluorescent lamp etc., and a discharge lamp for display units.

The starting time of the glow discharge lamp used as a glow starter tends to become longer in the dark. Therefore, it has been desired to shorten the discharge starting time in the dark. Here, the discharge starting time of the glow starter is the sum of the discharge delay time, the glow discharge duration, the extinction time, and the pulse generating time. The reason of the discharge starting time becoming longer in the dark is because the supply amount of primary electrons runs short, and the discharge delay time becomes longer.

Conventionally, radioisotopes as described below have been employed for shortening the discharge delay time.

A very small amount of a radioisotope such as $^{147}$Pm are coated or adhered by an electrochemical process on the vicinity of the electrode, and then metal such as Ni is further plated on it (known art I).

Gaseous radioisotope such as $^{85}$Kr or $^{3}$H is filled in a discharge vessel (known art II).

Since in the known arts I and II ionizable filling in the discharge vessel is able to be constantly ionized by the radioisotope, a discharge promptly starts at the time of lighting operation. Thus an effect of shortening the discharge delay time is remarkable. However, manufacturing of radioisotope applications require production facilities which must conform a radiation safety standard and requires a strict control for safety handling even if a very small amount of radioisotope is contained therein.

For averting the drawbacks of radioisotope, a glow starter free from radioisotopes has been sought. Japanese Laid-Open Patent Application Hei.10-255724 (hereinafter, referred to as "known art III"), discloses an application of phosphorescent phosphor for glow starters. According to the known art III, persistence is applied to an electrode surface even in the dark, so that photoelectrons are emitted, and primary electrons are supplied. Therefore, the discharge delay time is shortened. However, there is a limit to how long the specific amounts of the persistence can be preserved in a phosphorescent phosphor. According to the document, it is described that the limit of the time to preserve the specific amounts of the persistence in the Type-FL15 fluorescent lamp in the dark is 60 hours (2.5 days) to 90 hours (3.75 days) after turning on for 30 minutes with 100 lx of light per day. Furthermore, since the phosphorescent phosphor has to be provided at a portion to which the outside light reaches, there is a restriction that a light shielding material cannot be used for a discharge vessel.

Moreover, Japanese Laid-Open Patent Application Sho.54-64873 (hereinafter, referred to as "known art IV"), discloses an electroplating of zinc on electrodes in order to shorten the discharge starting time in the dark. In the known art IV, even though the plated zinc layer is oxidized, the oxidized layer sputters out by the glow discharge. So that the plated zinc layer is kept clean and tolerably active. Furthermore, the sputtering zinc atoms mate with impurity gases in the discharge vessel and adhere to the inner surface of the glass tube. Therefore, the ionizable filling is defecated and the releasing of the impurity gases from the glass tube is suppressed.

Therefore, according to the known art IV, since primary electrons are easily emitted from the electrode surface, the drawbacks shown in the known arts I to III are resolved.

However, according to the inventor's investigation, the known art IV has a problem that zinc adhering to a bimetal movable electrode or a fixed electrode quickly sputters out in accompany with the glow discharge or the high voltage pulsing discharge. Therefore, the known art IV is impossible to preserve a quick-starting feature.

Especially, the higher the gas pressure of the ionizable filling is for suppressing the sputtering of emissive materials, the higher the discharge starting voltage will be. Accordingly, there will be the drawbacks that the discharge delay time becomes longer, and the discharge starting time also becomes longer.

Furthermore, in the known art IV, it is found to accompany a drawback that the discharge starting probability changes with the thickness of the zinc film.

Furthermore, in the known art IV, although the discharge starting operation voltage may be lowered by using zinc for an emissive material, the discharge starting voltage elevates according to the gradual exhaustion of the emissive material during the life performance, so that it becomes hard to discharge. As a result, there was a problem of the discharge starting time becoming longer.

SUMMARY OF THE INVENTION

The present invention has an object to provide a glow discharge lamp, a glow starter and an electrode for glow discharge lamps and glow starters wherein discharge starting property in the dark is improved by shortening the discharge starting time, and a luminaire using thereof.

The present invention still has an object to provide a glow discharge lamp, a glow starter and an electrode for glow discharge lamps and glow starters wherein a sputtering of emissive material is extensively decreased, and a luminaire using thereof. The present invention still has an object to provide a glow discharge lamp, a glow starter and an electrode for glow discharge lamps and glow starters wherein impurity gases in a gaseous ionizable filling is eliminated so as to suppress an undesirable discharge delay or a rise of the discharge starting voltage, and a luminaire using thereof.

The present invention still has an object to provide a glow discharge lamp, a glow starter and an electrode for glow discharge lamps and glow starters wherein the decrease of the restarting voltage is suppressed so as to stabilize their operations during the life performance, and a luminaire using thereof.

To achieve the above objects, a glow discharge lamp according to the first aspect of the present invention, comprises a discharge vessel, a pair of electrodes mounted in the discharge vessel, ionizable filling which is principally made of a rare gas filled in the discharge vessel, and an emissive material which is made of zinc simple substance adhering to at least one of the electrodes.

To achieve the above objects, a glow discharge lamp according to the second aspect of the present invention, comprises a discharge vessel, a pair of electrodes mounted in the discharge vessel, ionizable filling which is principally made of a rare gas filled in the discharge vessel, and an emissive material which is made of zinc-alloy adhering to at least one of the electrodes.

To achieve the above objects, a glow discharge lamp according to the third aspect of the present invention, comprises a discharge vessel, a pair of electrodes mounted on inside the discharge vessel, ionizable filling in the discharge vessel which is principally made of a mixture of a first gas including neon (Ne) and a second gas including at least one of krypton (Kr), xenon (Xe), and argon (Ar), and emissive material containing a zinc formed on at least one of the electrodes.

To achieve the above objects, a luminaire according to the fourth aspect of the present invention, comprises a luminaire main body, the glow discharge lamp as defined in any one of the above aspects, which is mounted on the luminaire main body and a fluorescent electrode mounted on the luminaire main body.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
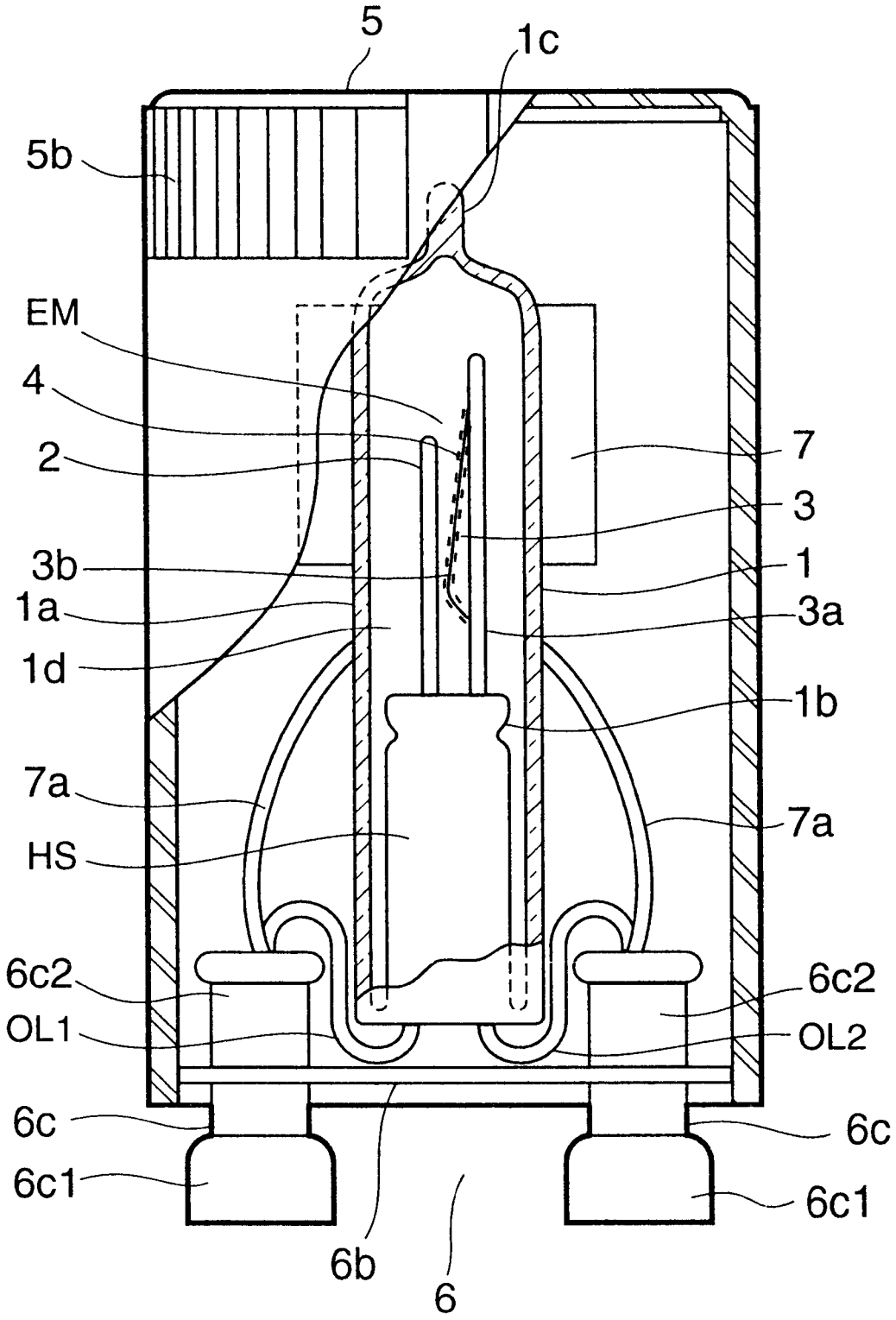
FIG. 1 is a front section showing a glow starter as a first embodiment of the glow discharge lamp according to the present invention.

Glow discharge lamps according to the present invention are principally comprised of a discharge vessel, a pair of electrodes, ionizable filling, and an emissive material. In the following descriptions, some definitions and their technical meanings are presented for following specific terms, unless otherwise specified.

Glow Discharge Lamp

The term, "glow discharge lamp" means a glow discharge lamp which operates by glow discharge, like a glow discharge lamp for display units, a cold-cathode fluorescent lamp and a glow starter, etc.

Discharge Vessel

The discharge vessel is formed by a glass having a high airtightness, a high workability, and a high heat resistance. The discharge vessel has a discharge space inside thereof. Furthermore, soft glass is suited for the discharge vessel in its excellent workability and cost effectiveness.

Electrode Mount

The glow discharge lamp according to the present invention has an electrode mount mounted thereon a pair of so-called cold-cathodes which are not provided with thermal electron emissive material. In the glow discharge lamp for display units, a pair electrodes are both fixed type electrodes. That is, in the glow starter, a pair of the electrodes may be a combination of a fixed type electrode and a movable electrode, or a combination of both movable electrodes. Here, in either discharge lamp, a pair of electrodes is mounted inside the discharge vessel.

A bimetal which is suitable for the glow starter may be formed by directly welding a first plate having a first thermal expansion coefficient, which is made of e.g., Fe—Ni alloy, and a second plate having a second thermal expansion coefficient, which is made of Ni—Cr—Fe alloy, Ni—Mn—Fe alloy, Mn—Cu—Ni alloy, or Cr—Cu—Ni alloy together, or indirectly bonding these two plates by intervening a third plate having a middle thermal expansion coefficient between them. A movable electrode is deformed by a temperature rise in accompany with the heat generated by a glow discharge between a pair of electrodes. When the temperature reaches a predetermined value or more, for instance, 50 to 150° C., the pair of the electrodes contact with each other. When the pair of electrodes are short-circuited by contact and the glow discharge terminates, the temperature of the movable electrode decreases, and thus the pair of electrodes will separate.

In the glow starter, the distance between two electrodes is set as about 0.1 to 2 mm so as to shorten the duration of the glow discharge as much as possible.

Furthermore, in order to mount a pair of electrodes on a determined position in the discharge vessel in keeping up a predetermined distance between the electrodes, it is able to use a electrode mount wherein the pair of electrodes have been previously mounted on a stem at a predetermined distance. The stem may be a flare stem or a bead stem as appropriate. Here, by covering the stem surface between electrodes with an insulating material, it is able to depress a creeping discharge and to prevent a pulse voltage drop.

Ionizable Filling

As ionizable filling which is principally made of a rare gas, mixed gas of neon (Ne) and at least one of krypton (Kr), xenon (Xe), and argon (Ar) are filled in the discharge vessel with a predetermined pressure, for instance, 650 to 13300 Pa, or more preferably, from 2600 to 10700 Pa. Furthermore, helium (He), hydrogen (H) or organic gas etc., may be added to the ionizable filling by way of shortening the glow discharge duration, increasing the glow discharge current, and preventing the decrease of restarting voltage during the life performance.

Here, by indispensably containing neon in the ionizable filling, the distance between the electrodes and the gas pressure range of the ionizable filling especially excellent in ionization property based on the well-known Paschen's law, thus it is able to lower the discharge starting voltage. In addition, since the sputtering of an emissive material made of zinc alloy as a principal constituent is suppressed, the discharge starting voltage need not be raised so much even though the pressure of the ionizable filling rises. When the ionizable filling is made of argon of 20% or less and residue (neon), the discharge starting voltage is remarkably decreased according to the Penning effect.

On the other hand, it was confirmed by an experimental test that when the ionizable filling was made of neon simple substance, or made of mixed gas of neon and argon using the Penning effect, not only the discharge starting voltage but also the restarting voltage is lowered. The restarting voltage is a voltage applied across a pair of electrodes, which is required for the glow starter to restart to shunt after a discharge lamp has been lighted. Since, when the restarting voltage drops below a predetermined value, a glow starter operates in a discharge lamp working and thus the pair of electrodes short with each other, the discharge lamp repeats alternately failing to work in accompany with the short of the electrodes and restarting the discharge lamp. Therefore, the restarting voltage must be avoided from lowering as much as possible.

Accordingly, by adding at least one of krypton, xenon, and argon to the ionizable filling which is made of neon as a principal constituent, it is able to prevent the sputtering of the emissive material and obtain a desirable discharge starting voltage and a desirable restarting voltage. It further preserves a sufficiently high restarting voltage even at the life-time end period as preventing to lower it.

Emissive Material

The emissive material is provided for covering a part or almost all of at least one of the pair of electrodes. The emissive material contains at least zinc simple substance or zinc alloy. The kind of the other metal forming alloy with zinc is not limited. For instance, the other metal may be one or a plurality of elements selected from a group of silver (Ag), aluminium (Al), gold (Au), barium (Ba), beryllium (Be), cerium (Ce), cobalt (Co), calcium (Ca), chromium (Cr), copper (Cu), iron (Fe), germanium (Ge), lanthanum (La), manganese (Mn), molybdenum (Mo), nickel (Ni), palladium (Pd), platinum (Pt), tellurium (Te), titanium (Ti), tungsten (W) and zirconium (Zr). However, in the group, a zinc alloy containing Ni as the other constituent is good in operation and inexpensive. Here, a zinc alloy containing Co, Fe, Cu, Al, Mn, Cr, or Mo as the other constituent is relatively good in operation and inexpensive.

The zinc alloy is preferable to have a melting point of 450° C. or more in order to improve the sputter-proof. Furthermore, the content of zinc in the alloy is preferably 50% or more, or more preferably 65 to 98%.

In order to place zinc or the zinc alloy in a film form on the electrode, it is able to use an electroplating, a hot-dip plating, a vacuum deposition, a CVD, or an ion-plating etc. Thus, it is easy to control the thickness of the film, and also it is able to form a zinc alloy film which is precise and contains less amount of impurities. By the way, the electroplating is most economical. As the electroplating, an eutectoid electroplating or a two-step electroplating could be used. The eutectoid electroplating is a process which uses a zinc alloy body as one electrode and an electrode to be electroplated as another electrode. The two-step electroplating is a process in which metal such as nickel to form an alloy with zinc is first electroplated on an object and then zinc is plated on the first plated film, or in which zinc is first plated on an object and then metal such as nickel is plated on the zinc film, and after that heated to form a zinc alloy film.

Here, when the zinc film is formed by the hot-dip plating, the plated film becomes too thick and far from precise. Furthermore, impurity gases released from the zinc film will increase in quantity, so that the discharge starting property is contrarily reduced.

Furthermore, the thickness of the zinc film is preferably in the range of 1.0 to 20 $\mu$m. However, it is more preferable to be in the range of 2.5 to 10 $\mu$m. If the thickness of the zinc film is less than 2.5 $\mu$m, the sputtering of zinc increases, while the discharge starting property is deteriorated. Furthermore, if the thickness is less than 1.0 $\mu$m, the lowering of the discharge starting property becomes remarkable. Furthermore, if the thickness of the zinc alloy exceeds 10 $\mu$m, the impurity gases released from the film increase in quantity, and the discharge starting property is deteriorated. If the thickness of the film exceeds 20 $\mu$m, the lowering of the discharge starting property becomes remarkable. The thickness of the zinc alloy film would more preferably be in the range of 3 to 7 $\mu$m, while it is optimally in the range of about 4.5 to 5.5 $\mu$m.

Furthermore, a part of the zinc film may be oxidized to form a zinc oxide etc. If there is zinc oxide, it will become easy to generate an exo-electron or cause a Malter effect, so that the discharge starting property in the dark will be improved.

In case of a zinc alloy containing Ni as a sub-constituent, $NiZn_3$ having a melting point of 881° C. is made by containing 25 mass % of Ni, $NiZn_{21}$ having a melting point of 870° C. is made by containing 19 mass % of Ni, and NiZns having a melting point of 790° C. is made by containing 11 mass % of Ni. In either case, a stable intermetallic compound is formed. Here, the zinc alloy may be solid solution.

Here also, as the emissive material, other emissive material could be added in addition to the zinc alloy. According to the inventor's investigation, since a carbon nanotube has an electron emissive property, the carbon nanotube may be added to the zinc alloy as the emissive material according to the present invention. The carbon nanotube may also be independently used.

Referring now to the attached drawings, preferred embodiments of the present invention will be described hereinafter.

FIG. 1 shows in section a glow starter according to the present invention.

Figure 2:
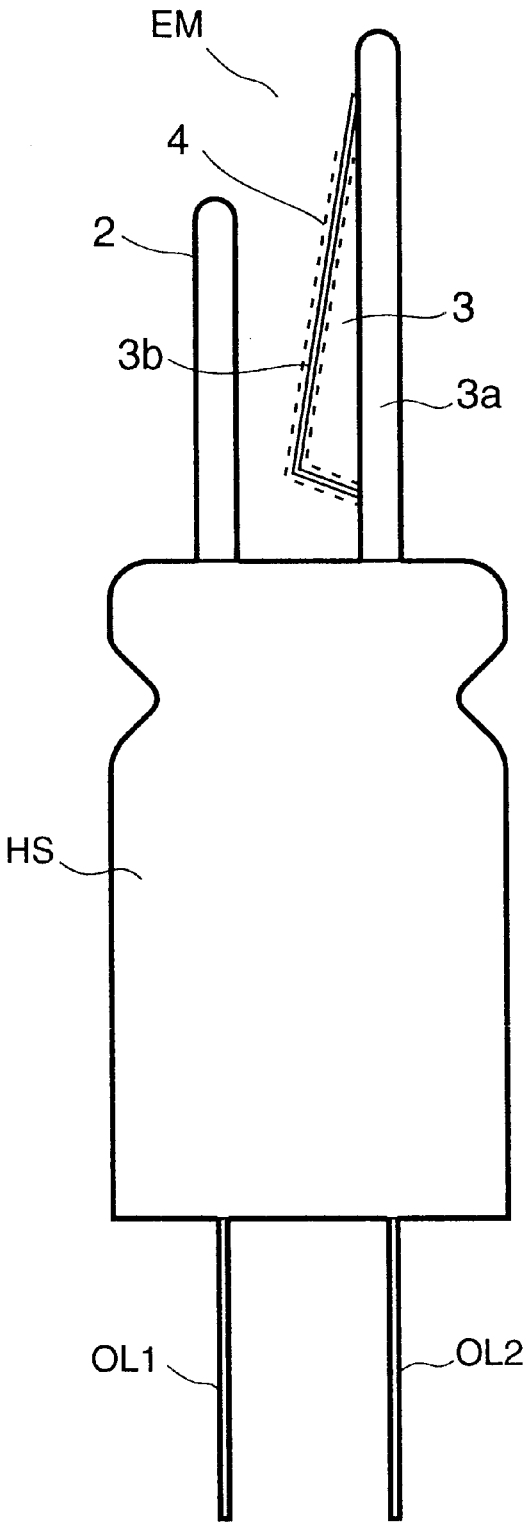
FIG. 2 is an enlarged front view showing an electrode mount in the glow starter, as shown in FIG. 1.

FIG. 2 is an enlarged front view showing the electrode mount of the glow starter, as shown in FIG. 1.

In FIGS. 1 and 2, the reference numeral 1 denotes a discharge vessel, the reference numeral 2 denote a fixed electrode, the reference numeral 3 denotes an emissive material, the reference numeral 5 denotes a case, the reference numeral 6 denotes a bulb-base, and the reference numeral 7 denotes a noise suppression capacitor. The glow starter is classified to a Type-P glow starter. The Type-P glow starter is characterized by that it has a noise suppression capacitor 7 in the housing 5, and the bulb-base 6 is classified to the Type-P21 pin bulb-base.

The discharge vessel 1 made of soft glass is provided with a glass-bulb 1*a*, a stem 1*b*, and an exhaustion tube vestige 1*c*. The discharge vessel 1 thus defines a discharge space id inside thereof. One end (bottom side on FIGS. 1 and 2) of the glass-bulb la is opened for bringing the electrode mount inside thereof, while on the other end (upper side on FIGS. 1 and 2) a thin exhaustion pipe is united therewith. The stem 1*b* is united with the glass-bulb la by fixing a flare stem HS as mentioned later on the open end of the glass-bulb 1*a*. The exhaustion tube vestige 1*c* is formed by chipping off an exhaustion tube ever existed after exhausting the air from the glass-bulb 1*a* through the exhaustion tube.

Mixed gas of neon and xenon is filled in the discharge vessel 1 as the ionizable filling.

The fixed electrode 2 and the movable electrode 3 have been pre-assembled as an electrode mount EM, as shown in FIG. 2. The electrode mount EM is brought inside the glass-bulb 1*a* through the open end thereof and fixed on a predetermined position in the discharge vessel 1. As shown in FIG. 2, the electrode mount EM is made of a flare stem HS, a fixed electrode 2, a movable electrode 3, and external lead-wires OL1 and OL2. An emissive material 4 then adheres to the movable electrode 3. According to that the flare portion of the flare stem HS is fixed on the open end of the glass-bulb 1*a*, the fixed electrode 2 and the movable electrode 3 are mounted inside the discharge vessel 1.

The fixed electrode 2 in the shape of metal rod is coupled to the external lead wire OL1, while the base end thereof is fixed to the flare stem HS.

The movable electrode 3 is comprised of a metal rod 3*a* and a bimetal 3*b*. The metal rod 3*a* longer than the fixed electrode 2 of the flare stem HS is fixed at its base end to a position facing the fixed electrode 2 and then connected to an external lead-wire OL2. The bimetal 3*b* is bent into an L-shape, and then its upper end is welded to the upper portion of the rod-like 3*a*, while its lower end touches with the metal rod 3*a* in a cold state, as shown in FIG. 1.

The emissive material 4, which is an zinc-nickel alloy made of 90 mass % of zinc constituent and 10 mass % of nickel constituent, is formed on the surface of the bimetal 3*b* within the range of thickness from 1.0 to 20 $\mu$m.

The housing 5 is formed in a cylindrical shape having a bottom by a polycarbonate resin which has a moderate light diffusion property by being added with appropriate doses of light transparent urea resin or titanium-oxide particles. To the open end of the housing 5, the bulb-base 6 is attached. Furthermore, it is provided with a knurl 5*b* at the edge of the head.

The bulb-base 6 is comprised of an insulating base 6*b* and a pair of bulb-base pins 6*c* and 6*c*. The insulting base 6*b* closes the open end of the housing 5. The bulb-bases 6*c* and 6*c* of a pair, which are separated from each other, are penetrated and fixed to the insulting base 6*b*. Each bulb-base 6*c* is provided with an engaging protrusion 6*c*1 which is protruded to the housing 5, and a connection 6*c*2 inside the housing 5.

The noise suppression capacitor is coupled in parallel between the fixed electrode 2 and the movable electrode 3, since its lead wires 7*a* and 7*a* are coupled to the connections 6*c*2 and 6*c*2 of the pair of the pins 6*c* and 6*c*.

Figure 3:
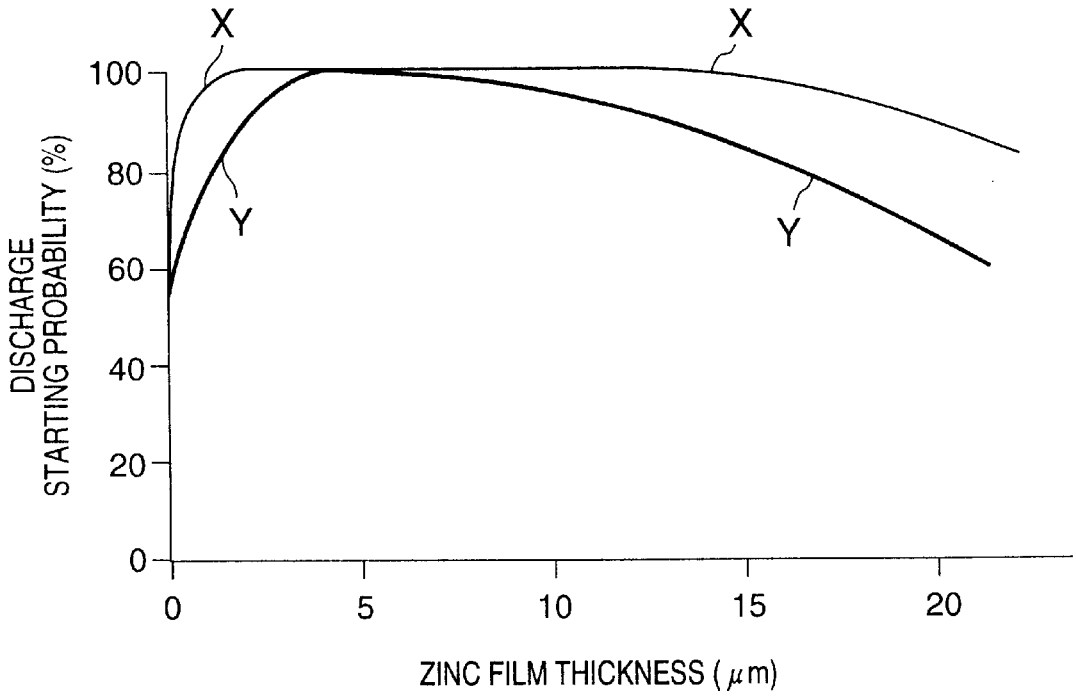
FIG. 3 is a graph showing a relation between the thickness of the zinc film and the discharge starting probability in the glow starter according to present invention.

Referring now to FIG. 3, the electrical properties of the glow starter according to the present invention will be described.

FIG. 3 is a graph showing the relation between the thickness of the zinc film and the discharge starting probability in the glow starter according to the B1 aspect of the present invention, which is provided with an emissive material principally made of zinc, which adheres to at least one of a pair of electrodes in a thickness of 0.1 to 10 $\mu$m. In FIG. 3, the abscissa axis indicates the thickness of the zinc film by $\mu$m while the ordinate axis indicates the discharge starting probability by %. Here, FIG. 3 shows the measured discharge starting probabilities of test pieces of the glow starter for fluorescent lamps with 40 W rating power wherein the thickness of the zinc film of the emissive material fell in and out of the scope of the present invention. The measurement was performed on 20 test pieces of the glow starter having the same thickness of the zinc film by applying a lower operating voltage standing at 180 V in two stages, i.e., in the initial operation stage and the extremely later stage past 6000 times of operation with each 25 seconds of on-duration and 35 seconds of off-duration and then left in the dark for 15 hours. In FIG. 3, the curve "A" plots the discharge starting probabilities of the test pieces in the initial operation stage, while the curve "B" plots the discharge starting probabilities of the test pieces after blinking 6000 times. Here, the term "discharge starting probability" means the probability that the fluorescent lamp with 40 W rating power starts to light within 10 seconds, preferably 8 seconds in the dark at normal temperatures (around 25° C.).

As shown in FIG. 3, in the range of 1 to 15 $\mu$m of zinc film thickness the 100% of the test pieces have started discharging in the initial operation stage. While even in the 20 $\mu$m of zinc film thickness about 90% of the test pieces have started discharging. On the other hand, if the thickness of the zinc film exceeds 20 $\mu$m, after 6000 times of turning on and off the discharge starting probability decreases to 70%. Thus such a too thick zinc film is improper. Furthermore, when the thickness of the zinc film decreases under 1.0 μm, the discharge starting probability tends to remarkably fall and the life-time is shortened because of a very small amount of zinc adhering. Thus such a too thin zinc film is also improper. When the thickness of the zinc film is in the range of 3 to 7 μm, the discharge starting probability and the life-time are both favorable. Thus such a thickness range of the zinc film is favorable. Furthermore, when the thickness of the zinc film is in the range of 4.5 to 5.5 μm, the discharge starting probability is almost 100%. Therefore, such a thickness range of the zinc film is optimum.

Besides, in the glow starter according to the first aspect of the present invention, the emissive material comprised of a zinc film of a predetermined thickness is activated so as to emit electrons. Thus, the discharge starting property of the glow-discharge lamp in the dark is improved. Furthermore, since the glow starter is provided with a zinc film whose thickness is defined in a predetermined range, the exhaustion amount of zinc etc., by sputtering decreases, and the amount of the impurity gases released from the zinc alloy film also decreases. Thus the electron emissive operation by the zinc film is able to be continued during the life performance.

Referring now to FIGS. 4 to 7, electrical properties of the glow starter according to the present invention will be described. In the drawings, the solid-line curve "a" plots the characteristic of the glow starter using the zinc-nickel alloy for the emissive material 4 (hereinafter, referred to as illustrative example "a". While the dotted-line curve "b" plots the characteristic of the glow starter using zinc simple substance for the emissive material 4 (hereinafter, referred to as illustrative example "b"). The illustrative example "b" is the same in specifications with the illustrative example "a", except that the emissive material is made of zinc simple substance. Furthermore, the graphs, as shown in FIGS. 4 to 7, plot the measured electrical properties of respective 20 test pieces of the illustrative examples "a" and "b". The ordinate axis represents by percentage the amount (incidence) of glow starters with respective discharge starting times on the abscissa axis per each 20 samples. Here, the discharge starting time was measured in such a way that an ON-state for 25 seconds and an OFF-state for 35 seconds are alternately repeated.

Figure 4:
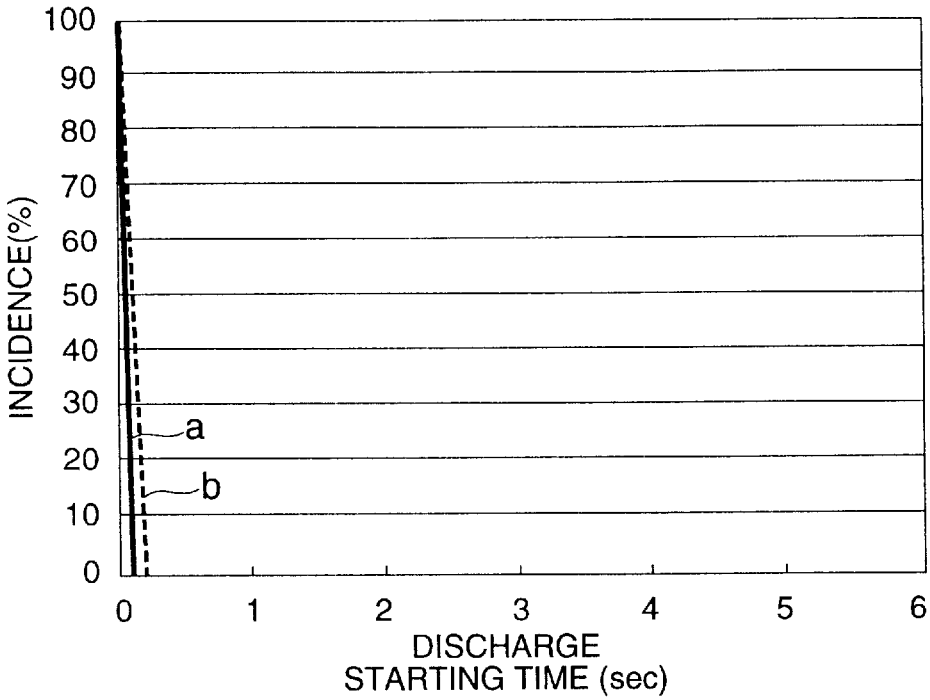
FIG. 4 is a graph showing by comparison incidences of the discharge starting times in the initial operation stage of two illustrative examples of the glow starter according to the present invention.

FIG. 4 shows by comparison dispersion in the discharge starting times in the initial operation stage of the illustrative examples "a" and "b".

Figure 5:
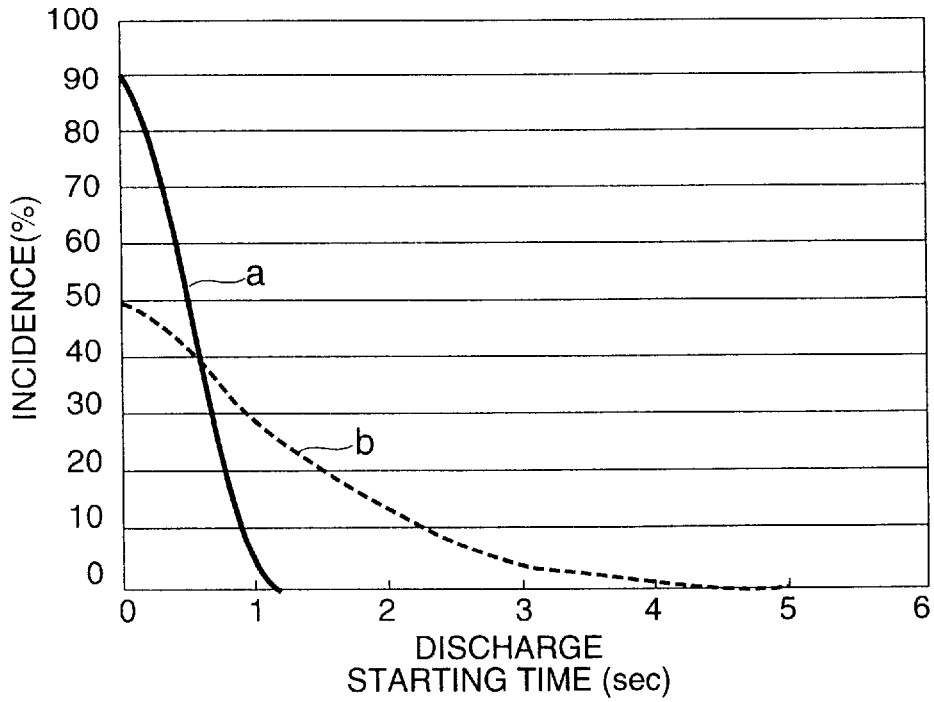
FIG. 5 is a graph showing by comparison incidences of the discharge starting times after turning on and off 6000 times of the two illustrative examples of the glow starter according to the present invention.

FIG. 5 shows by comparison incidences of the discharge starting times after turning on and off 6000 times the illustrative examples "a" and "b".

As shown in FIG. 4, the discharge starting time is extremely short, and it is about 0.1 seconds at longest in the initial operation stage in the illustrative example "a". On the other hand, the longest time of the discharge starting time is about 0.2 seconds in the illustrative example "b". Accordingly, the discharge starting time at the initial operation stage is very short in both of the illustrative examples "a" and "b", and there is no remarkable difference between them.

On the other hand, after lighted 6000 times, the discharge starting time of the illustrative example "a" is within 1 second, however, the discharge starting time of the illustrative example "b" is within 4 seconds.

Figure 6:
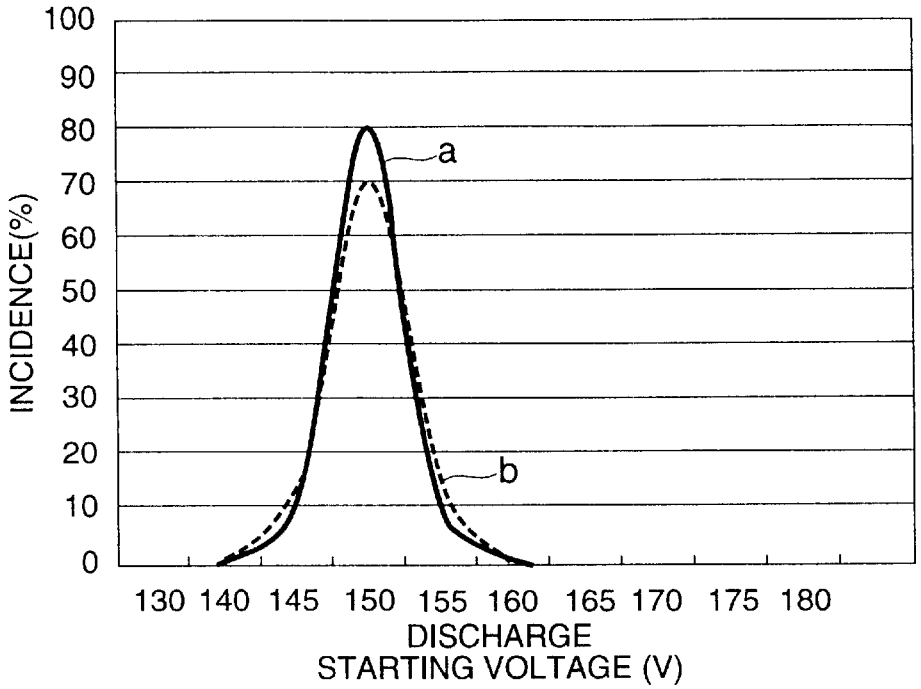
FIG. 6 is a graph showing by comparison incidences of the discharge starting voltages in the initial operation stage of the two illustrative examples of the glow starter according to the present invention.

FIG. 6 shows by comparison incidences of the discharge starting voltage in the initial operation stage of the illustrative examples "a" and "b".

Figure 7:
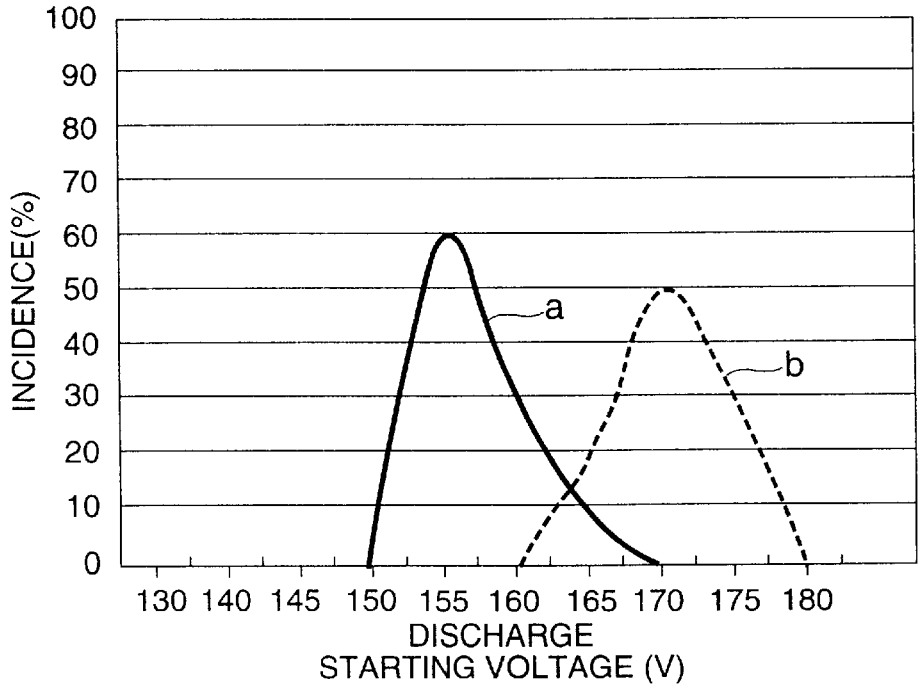
FIG. 7 is a graph showing by comparison incidences of the discharge starting voltages after turning on and off 6000 times of the two illustrative examples of the glow starter according to the present invention.

FIG. 7 shows by comparison the discharge starting voltages after turning on and off 6000 times the illustrative examples "a" and "b".

As shown in FIG. 6, the discharge starting voltages in both of the illustrative examples "a" and "b" varied in about 10 V backward and forward from the mode of 150 V at the initial operation stage. However, the dispersion in the illustrative example "a" was sharper than that in the illustrative example "b". On the other hand, as shown in FIG. 7, the discharge starting voltage of the illustrative example "a" after turning on and off 6000 times is varied in the range of 150 V to 170 V from the mode of 155 V. However, the discharge starting voltage in the illustrative example "b" after turning on and off 6000 times varied from 160 to 180 V, but the mode value was 170 V. This is caused by that since the amount of the gas released from the emissive material in the illustrative example "b" is more than that of the illustrative example "a", the discharge starting voltage is relatively elevated.

Figure 9:
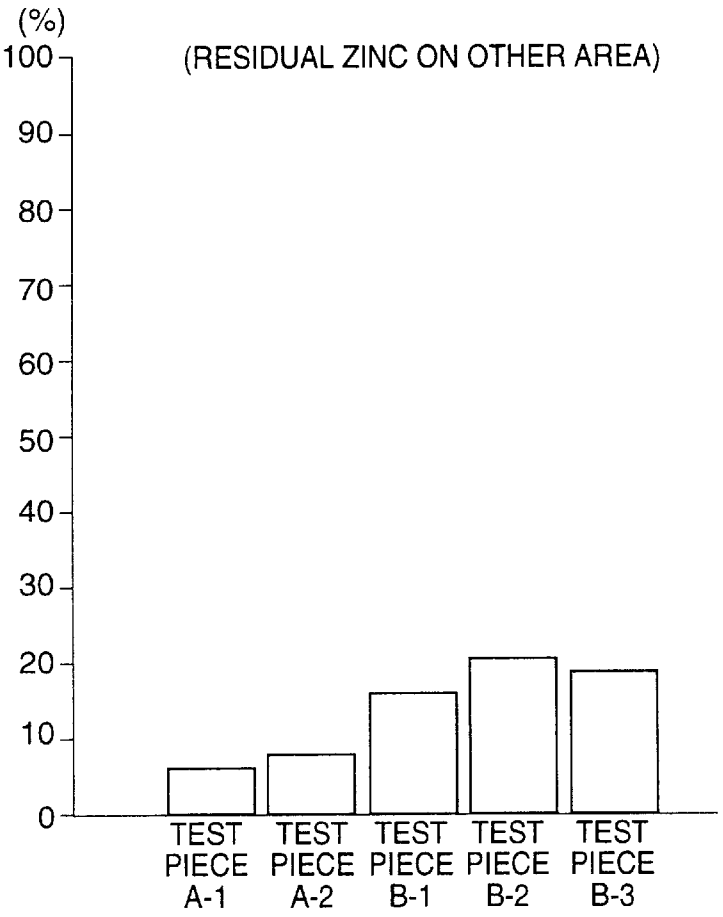
FIGS. 8 and 9 are graphs showing by comparison the amount of residual zinc on the bimetal the bimetal and other area after turning on and off 1000 times of the two illustrative examples of the glow starter according to the present invention.
Figure 8:
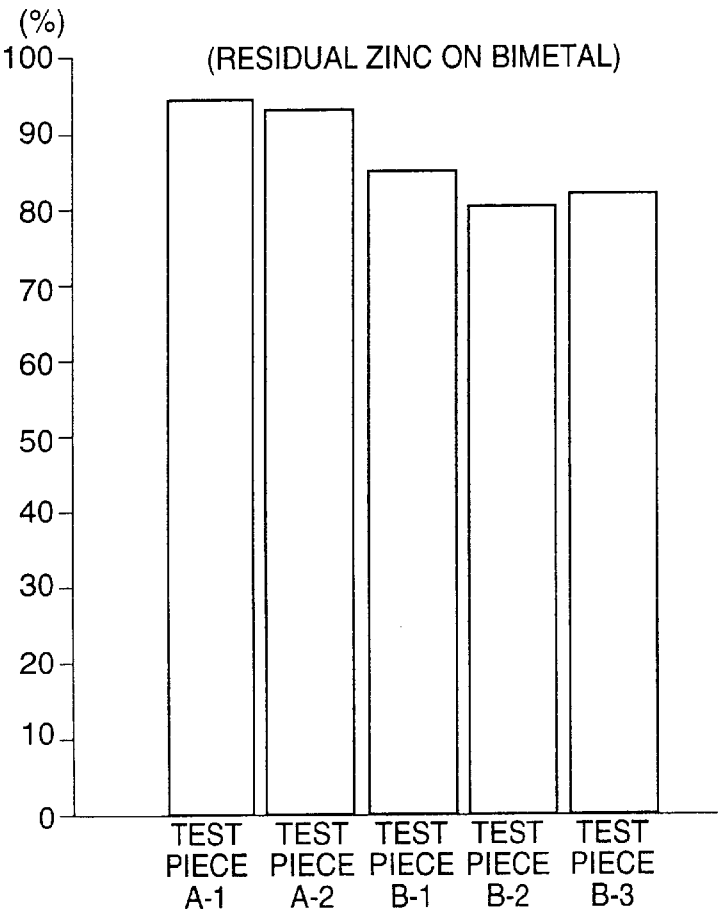

FIGS. 8 and 9 show by comparison the amount of residual zinc on the bimetal and other area after turning on and off 1000 times the illustrative examples "a" and "b".

As seen from FIGS. 8 and 9, the emissive material in the test pieces A-1 and A-2 of the illustrative example "a" remains on the bimetal more than that in the test pieces B-1 to B-3 of the illustrative example "b". On the other hand, few emissive material remains on parts other than the bimetal, in the test pieces A-1 and A-2 of the illustrative example "a". This shows that the sputtering of the emissive material in the illustrative example "a" is less than the sputtering of that in the illustrative example "b".

Figure 10:
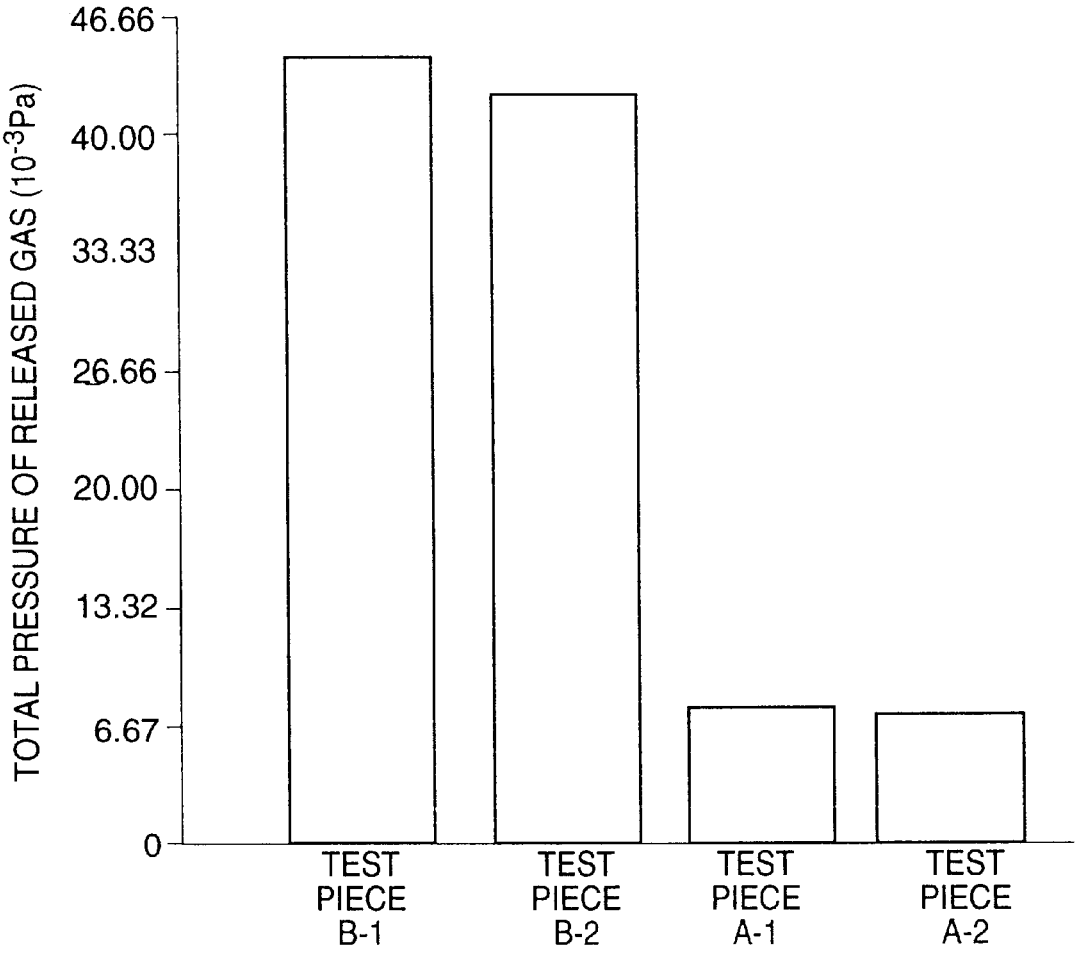
FIG. 10 is a graph showing by comparison the release amount of gas per one bimetal in respective test pieces of the two illustrative examples of the glow starter according to the present invention.

FIG. 10 shows by comparison the amount of gas released from one bimetal of the test piece A-1 of the illustrative example "a", the test pieces B-1 and B-2 of the illustrative example "b" and a test piece C-1 of a comparative example. In FIG. 10, the ordinate axis represents a total released gas pressure by Pa. Here, the comparative example is a glow starter wherein a bimetal is not adhered with any emissive material.

As seen from the graph of FIG. 10, the amount of gas released from the bimetal in use of zinc-nickel alloy emissive material is remarkably smaller than the gas in use of zinc emissive material, and is almost the same with that of the bimetal not adhered with emissive material.

When the glass whose MgO exceeds 2 mass % and $Na_2O$ is 10 mass % or less, or the glass whose $Al_2O_3$ exceeds 1.8 mass % and $Na_2O$ is 10% or less is used as a glass of the discharge vessel 1 or a stem 1*b*, the discharge staring time will be shorten further. This may be caused by that exo-electrons are emitted from Mg or $Al_2O_3$ in the glass, and the exo-electron works as an electron source for starting discharge. Here, in case of $Na_2O$ exceeding 10 mass % in the glass, the effect of shortening the discharge starting time will be deteriorated even if the glass contains a predetermined amount of MgO or $Al_2O_3$. It may be caused by that the electric conductivity of the glass is enhanced by that Na exists in the glass in large quantity. That is, it is surmised that although some mechanical or electric stimulus are necessary for making exo-electrons to be emitted from MgO, the leak current passes inside the glass not through a surface since the glass contains Na in large quantity, thus these electric stimulus are not applied to the glass.

Here, an exemplary composition of a favorable glass is shown in Table 1.

TABLE 1

| Component | Quantity (mass %) |
|---|---|
| $SiO_2$ | 60 to 75 |
| $Li_2O$ | 1 to 5 |
| $Na_2O$ | ≤10 |
| $K_2O$ | 3 to 8 |
| SrO | 4 to 8 |
| BaO | 1 to 4.5 |
| MgO | 2 to 8 |

Here, this glass is so-called as lead-free glass which does not contain lead substantially. When this lead-free glass is used for the stem 1*b* of the glow starter, the discharge starting time is shorten furthermore.

Figure 11:
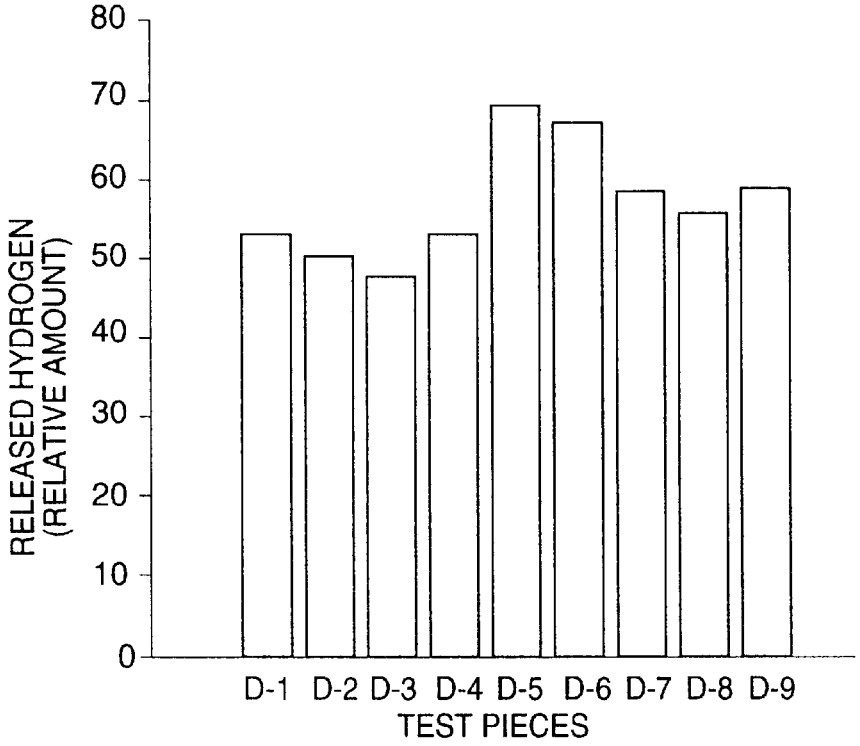
FIGS. 11 and 12 are graphs showing incidences of the amount of hydrogen released from test pieces of electrode of the glow starter according to the present invention, on which zinc alloys are respectively electroplated with different current densities.
Figure 12:
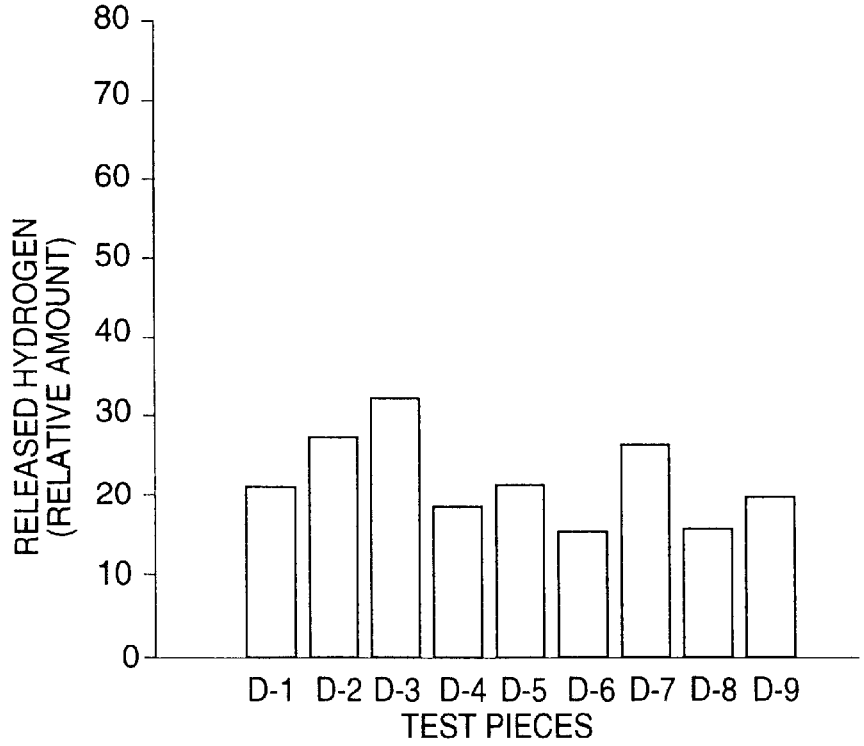

FIGS. 11 and 12 show incidences of the amount of hydrogen released from electrodes of the glow starter according to the present invention on which the zinc alloy is electroplated with different current density; FIGS. 11 and 12 show the amounts of hydrogen released from nine test pieces D-1 to D-9 of electrodes in which zinc alloy are electroplated on their bimetal at current densities of 10 $A/dm^2$ and 5 $A/dm^2$, respectively. The test pieces D-1 to D-9 of electrodes are heated in vacuo up to 1000° C., and then the amounts of hydrogen released are measured by a mass spectrometer.

As seen from FIGS. 11 and 12, the amount of hydrogen released is relatively small in the electroplating at the low current density. In other test pieces of glow starters fabricated by using electrodes with the same specification with the test pieces D-1 to D-9, the discharge starting time in the dark was sufficiently short even after turning on and off 6000 times.

Furthermore, in the illustrative examples of the glow starter according to the present invention, as a result of analyzing a film adhering on the inner surface of the discharge vessel by sputtering from an electrode after turning on and off for predetermined frequency count, the film was principally made of zinc-alloy, and the zinc-alloy film had absorbed hydrogen, while a part of the zinc-alloy had been oxidized.

Furthermore, the ionizable filling in the discharge vessel of the illustrative example of the glow starter according to the present invention is principally made of neon and xenon. While, the amount of hydrogen contained in the ionizable filling was in the range of 0.3 to 2.8%.

In the illustrative example of the glow starter according to the present invention, the zinc constituent in the zinc alloy becomes active so as to emit electrons. The primary electron emissive capability of zinc alloy is almost equivalent to that of zinc simple substance. Thus, the discharge starting property of the glow discharge lamp in the dark is improved.

Furthermore, since zinc alloy has a melting point which is higher than that of zinc simple substance, the sputtering of substance therefrom is remarkably suppressed. Therefore, the problem that the discharge starting property is deteriorated in accompany with the exhaustion of the electron emissive material is remarkably improved. Therefore, it is able to prevent that the discharge starting property is deteriorated as the emissive material is exhausted with relative fast. Furthermore, the amount of impurity gases released from the zinc alloy is less than that of the case in which the covering film of zinc simple substance is used as the emissive material. This may be caused by that the impurity gases occluded to the zinc alloy film at a plating time is less than those of zinc simple substance. Therefore, since there are a very small amount of impurity gas released during the life performance, the discharge starting property is deteriorated, so that the life-time of the glow-discharge lamp becomes longer.

Now it will be described a third illustrative example "c" of the glow starter according to the present invention, which is characterized by that ionizable filling is comprised of first gas including neon (Ne) and a second gas including at least one of krypton (Kr), xenon (Xe), and argon (Ar) in a partial pressure ratio in the range of 0.1 to 60% of the ionizable filling.

Figure 13:
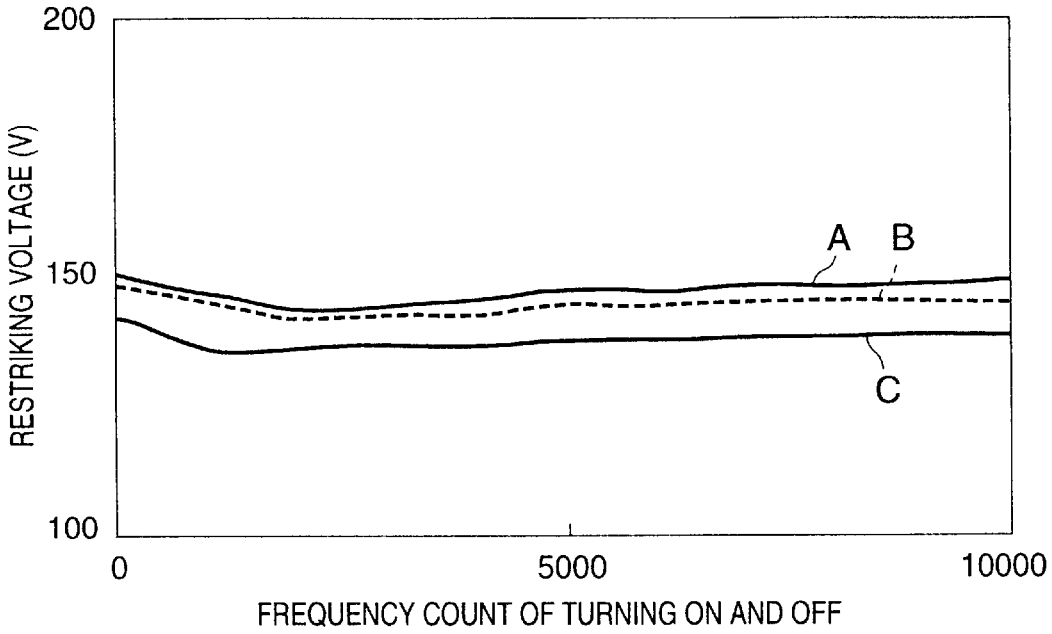
FIG. 13 is a graph showing by comparison changes of the restarting voltages of the glow starters according to the present invention and a comparative glow starter with the increase of the frequency count of turning on and off.
Figure 14:
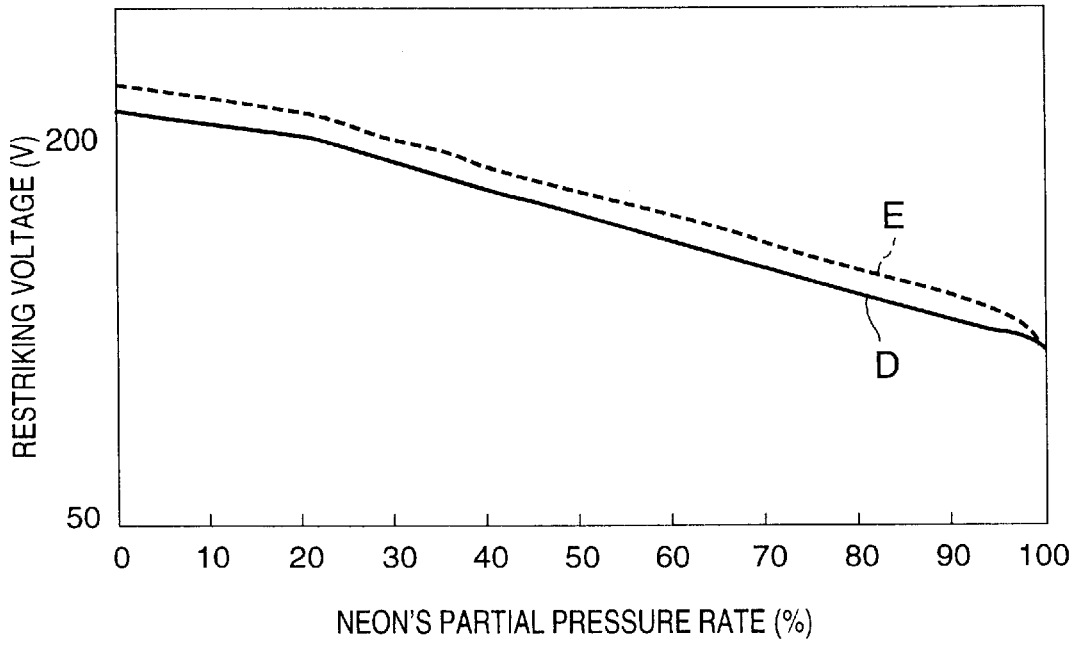
FIG. 14 is a graph showing the change of the restarting voltages of the glow starter according to the present invention with a difference of the gas composition ratio.

FIGS. 13 and 14 show in graphs the characteristics of the illustrative example "c" of the glow starter according to the present invention in different compositions of the ionizable filling.

FIG. 13 shows the changes of the restarting voltages of the glow starters with the increase of the frequency count of turning on and off. In FIG. 13, the heavy solid line curve "A" and the dotted line curve "B" stand for illustrative examples "A" and "B" of the glow starter according to the present invention, while the thin solid line curve "C" stands for a comparative example "C".

The emissive materials of the illustrative examples "A" and "B" and the comparative example "C" have a composition as follows.

Illustrative example "A": 90% of Neon (Ne), and 10% of Xenon (Xe)

Illustrative example "B": 90% of Neon (Ne), and 10% of Krypton (Kr)

Comparative example "C": 100% of Argon (Ar)

As respective 50 test pieces (rated voltage; 200 V) of the illustrative examples "A" and "B" and the comparative sample "C" with the composition as listed above were measured their discharge starting time in the dark by applying a lower operating voltage standing at 180V, the discharge starting time of all the test pieces fell in the allowable range.

FIG. 13 shows the changes of the restarting voltages of the glow starters according to the increase of the frequency count of turning on and off in each of the illustrative examples "A" and "B" and the comparative sample "C".

As seen from the curve "C" of the comparative example "C", as the frequency count of turning on and off increases in the initial operation stage, the restarting voltage was remarkably deteriorated. After turning on and off 1000 times, the restarting voltage is lowered below the lowest permissible level. In the illustrative examples "A" and "B", the restarting voltages during the life performance were preserved higher than the lowest permissible level.

FIG. 14 shows the change of the restarting voltage of the glow starter according to the gas composition ratio. Here, the solid line curve "D" stands for a first illustrative example "D" of the ionizable filling comprising a mixed gas of neon and xenon, while the dotted line curve "E" stands for a illustrative example "E" of the ionizable filling comprising a mixed gas of neon and krypton. As seen from the curve "D", the partial pressure ratio of xenon became 3% or less, the restarting voltage is lowered below the lowest permissive level. Furthermore, although the restarting voltage was preserved higher than the lowest permissive level when the partial pressure ratio exceeded 60%, there was a tendency of the discharge starting time in the dark becoming longer. Furthermore, as seen from the curve "E", the illustrative example "E" of the ionizable filling exhibited the same changing tendency of the restarting voltage as the illustrative example "D" of the ionizable filling, when the partial pressure ratios of krypton and xenon were changed. As seen from FIG. 14, almost same tendencies were obtained in the characteristics of the restarting voltage and the discharge starting time in the dark for the illustrative examples "D" and "E" of the ionizable fillings.

Accordingly, glow starters comprised of emissive material made of the zinc alloy adhering to electrodes, ionizable filling having neon as principal gas and at least one of argon, krypton, and xenon in the range of 0.1 to 60%, or more preferably in the range of 50 to 60%, the restarting voltage is preserved sufficiently higher during the life performance and the discharge starting time in the dark can be sufficiently decreased.

In the illustrative examples of the glow starter, it is able to prevent the decrease of the restarting voltage during the life performance, and also able to preserve the restarting voltage in sufficiently higher even at the life-time-end period. Furthermore, the sputtering of zinc or the zinc alloy at the starting operation is suppressed, so that the life-time of the glow starter will become longer.

Furthermore, as the illustrative examples of the glow starter utilizes ionizable filling with an optimal composition, the discharge starting voltage can be lowered and the lowering of the restarting voltage is inhibited. Accordingly, the lowering of the restarting voltage is suppressed during the life performance, so that it is operated stably during the life performance. Furthermore, it is able to achieve a long life-time by inhibiting the sputtering.

Referring now to FIGS. 15 to 20, other embodiments of the glow starter or the glow discharge lamp according to the present invention will be described. In FIGS. 15 to 20, the same elements as those, as shown in FIGS. 1 and 2 are assigned with the same reference numerals and omitted their explanations.

Figure 15:
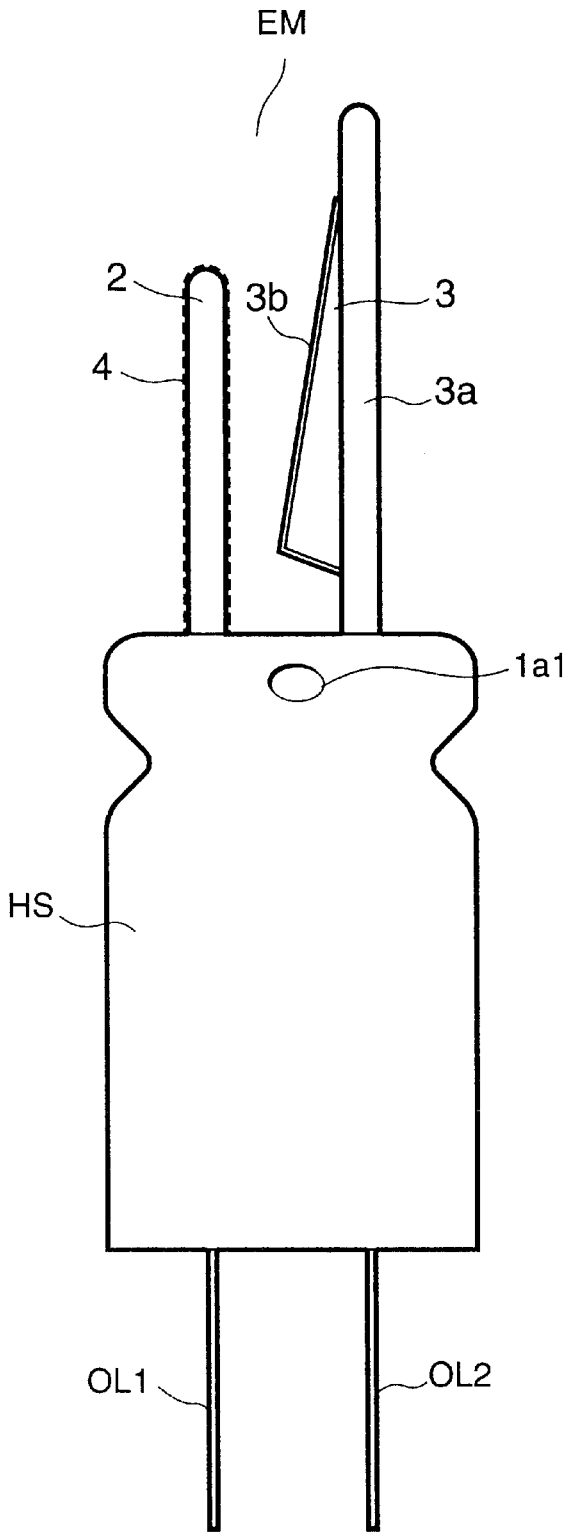
FIG. 15 is an enlarged front view showing a modification of the electrode mount, as shown in FIG. 2.

FIG. 15 shows a modification of the electrode mount EM.

This aspect is different from the electrode mount EM, as shown in FIG. 2, by that the emissive material 4 is adhered to the fixed electrode 2. In addition, an exo-electron emissive material 1*b*1 is adhered to the flare stem HS. The exo-electron emissive material 1*b*1 is formed by blending powders of $Al_2O_3$, MgO, and Be with a binder. Accordingly, by using the exo-electron emissive material 1*b*1, the exo-electron emissive material 1*b*1 compensates insufficient primary electrons even though a large amount of impurity gases are released from the zinc alloy. Therefore, it was admitted that the effect of shortening the discharge starting time by the zinc alloy is definitely preserved.

Figure 16:
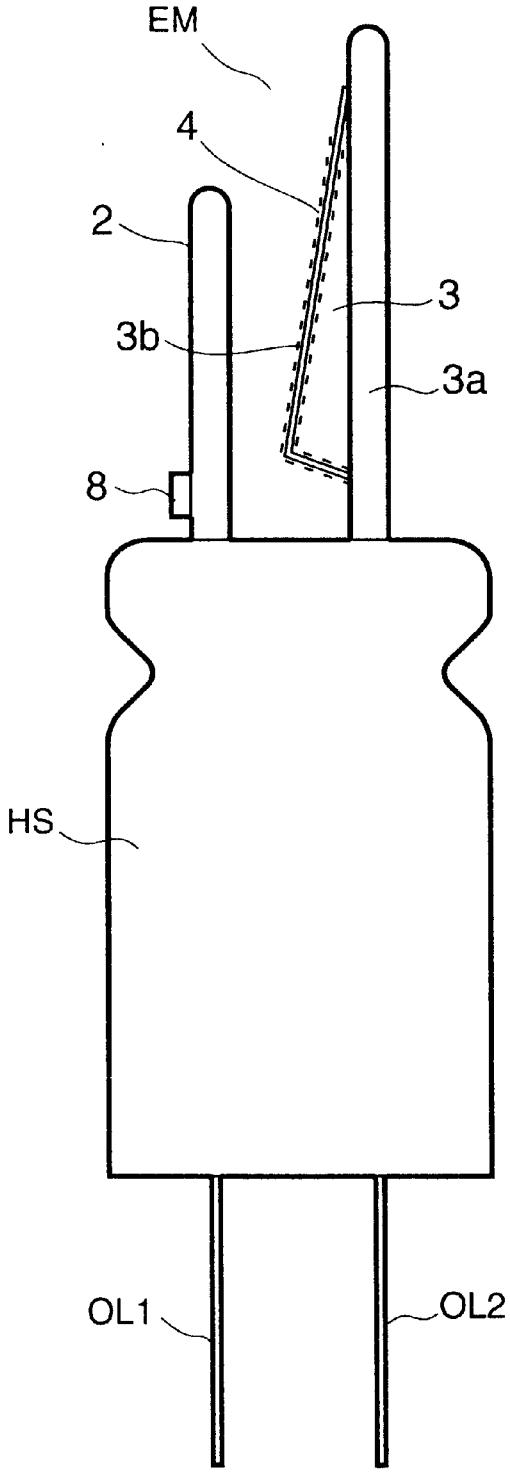
FIG. 16 is an enlarged front view showing another modification of the electrode mount, as shown in FIG. 2.

FIG. 16 shows still another modification of the electrode mount EM.

The modification of the electrode mount is different from the electrode mount EM, as shown in FIG. 2, by that the getter 8 is adhered to the fixed electrode 2. That is, the getter 8, which is a ZrAl alloy coated plate, is fixed to the vicinity of the base of the fixed electrode 2 by a spot welding. The getter 8 principally absorbs $H_2$ gas released from the emissive material 4 during the life performance.

Figure 17:
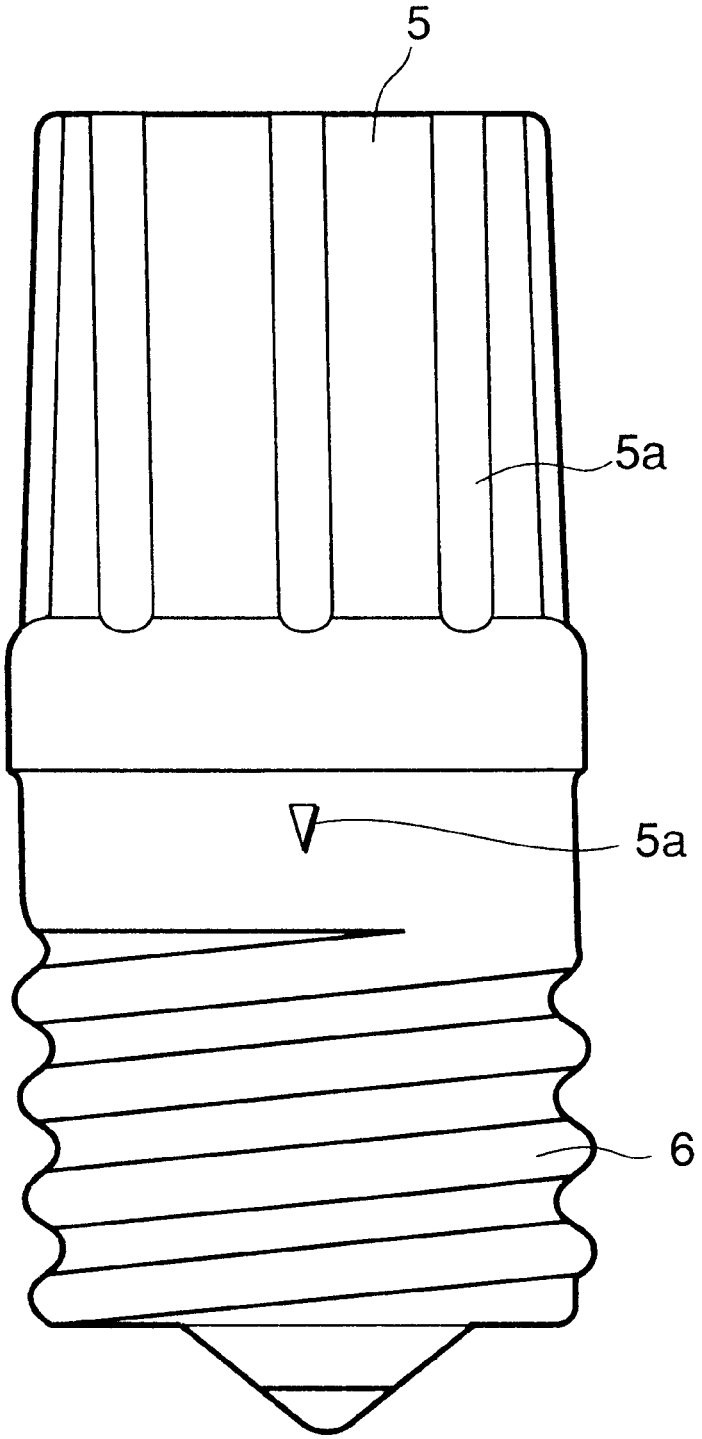
FIG. 17 is a front view showing a different outer shape of the glow starter according to the present invention.

FIG. 17 shows a different shape of the glow starter according to the present invention.

Figure 18:
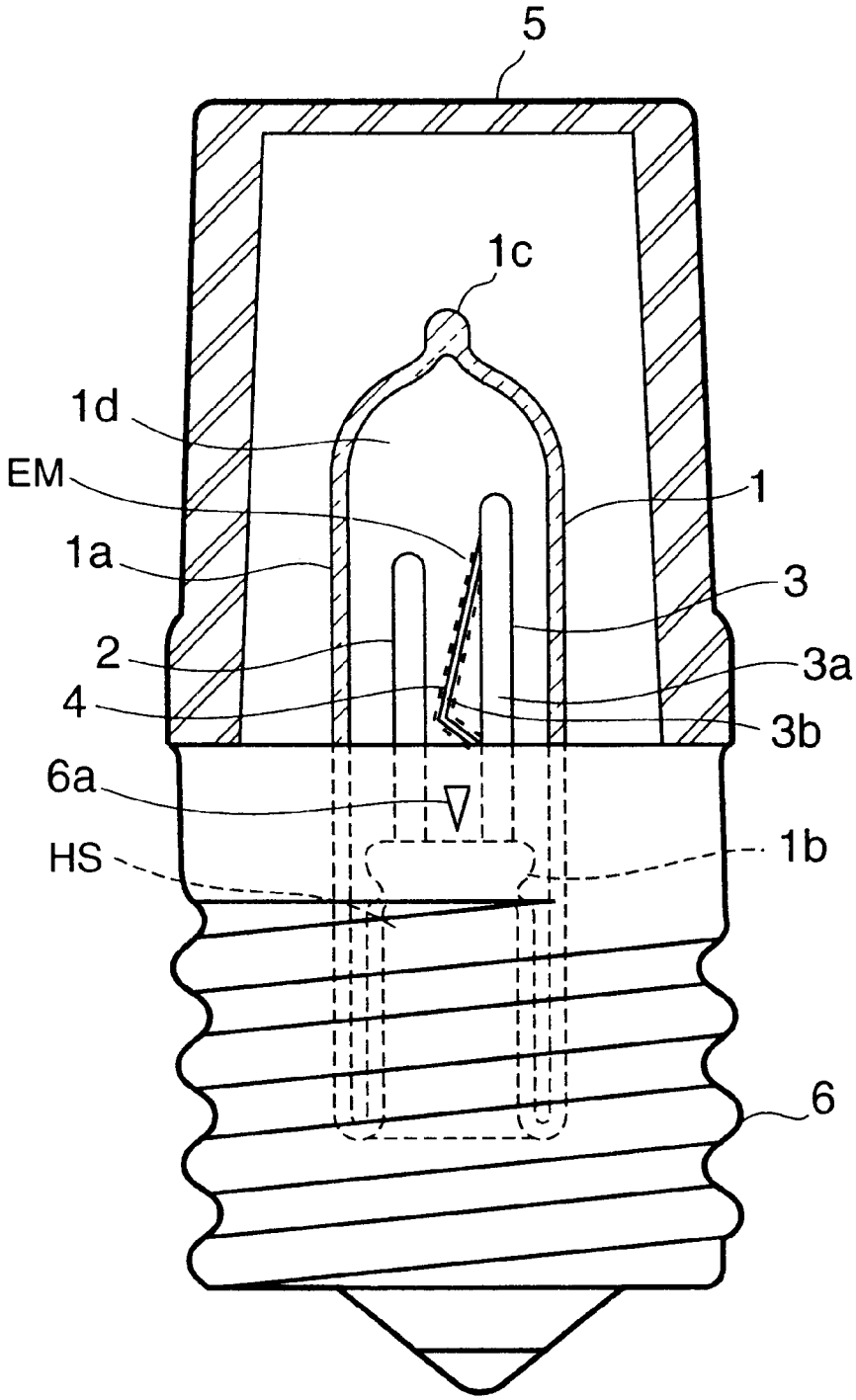
FIG. 18 is a partial section front view of the glow starter, as shown in FIG. 17.

FIG. 18 shows a principal part of the glow starter, as shown in FIG. 17.

The glow starter, as shown in FIGS. 17 and 18, is classified to a Type-E glow starter.

A housing 5 is formed into a cylindrical shape having a bottom made of polycarbonate resin which has moderate light diffusion property by being added with appropriate doses of the titanium-oxide particles. In addition, a knurl 5*a* is formed around the rim of the housing 5. Furthermore, the housing 5 accommodates the discharge vessel 1 in which the pair of electrodes 2 and 3 is disposed and the emissive material 4 is filled. Here, a pair of the electrodes 2 and 3, the emissive material 4, and the ionizable filling are the same in construction as those of the glow starter, as shown in FIGS. 1 and 2.

A bulb-base 6, which is a Type-E17 screw bulb-base, is fit to the open end of the housing 5, and then caulked on the open end of the housing 5. Here, the reference "6*a*" in FIG. 18 denotes a caulking scar, that has been marked at the time of caulking.

Figure 19:
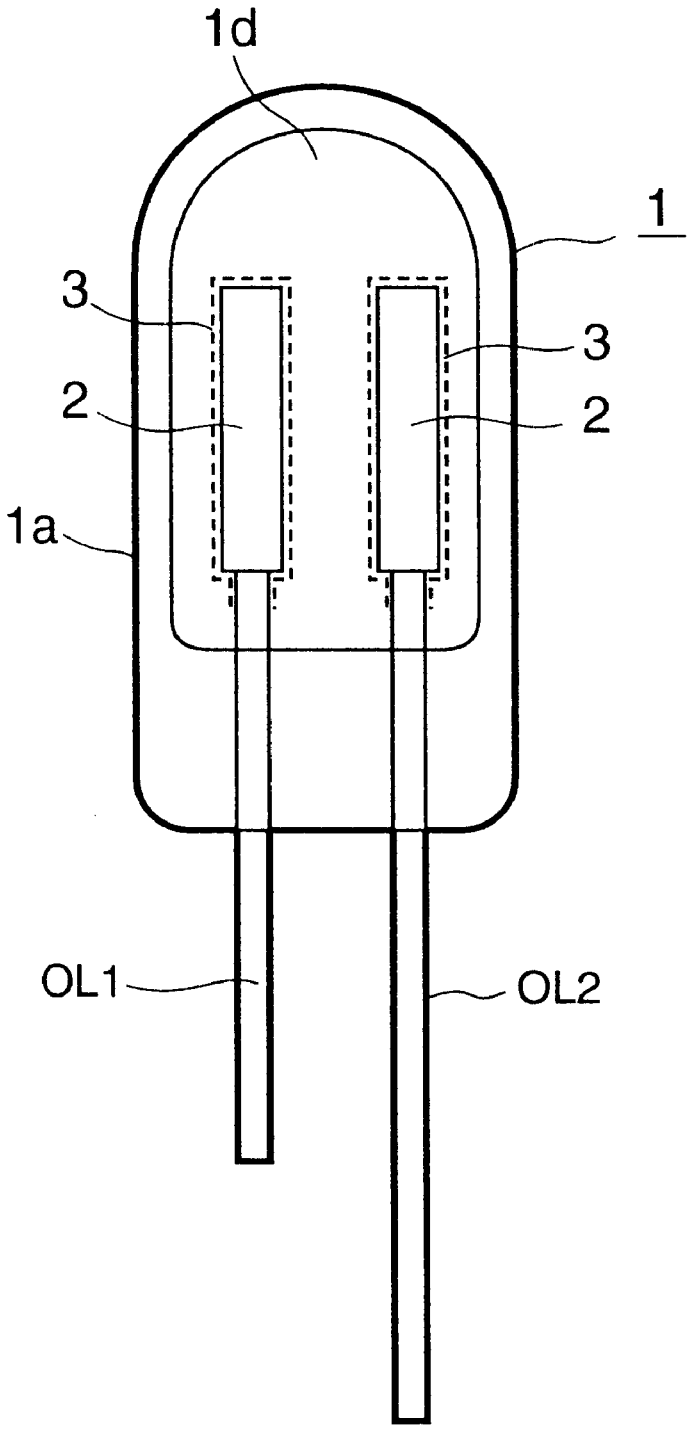
FIG. 19 is a front view showing a straight-tube glow discharge lamp for display units as a second embodiment of the glow discharge lamp according to the present invention.

FIG. 19 shows a straight-tube glow discharge lamp for display units, i.e., a second embodiment of the glow discharge lamp according to the present invention.

In FIG. 19, a pair of the electrodes 2, 2 are both fixed electrodes.

Emissive materials 4 are adhered to the pair of electrodes 2, 2.

Figure 20:
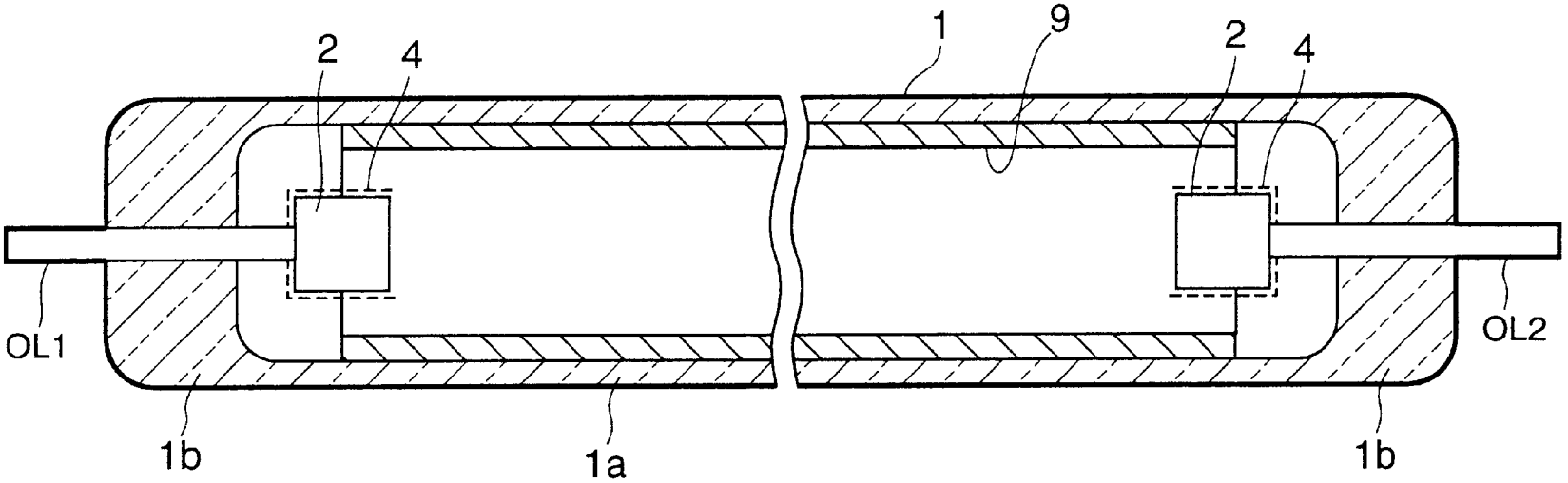
FIG. 20 is a partial vertical section of a cold-cathode fluorescent lamp as a third embodiment of the glow discharge lamp according to the present invention.

FIG. 20 is a partial vertical section of a cold-cathode fluorescent lamp, i.e., a third embodiment of the glow discharge lamp according to the present invention In the cold-cathode fluorescent lamp, a pair of cold-cathode electrodes 2, 2 are provided on both ends of an elongate discharge vessel 1 in which a fluorescent substance layer 9 is formed on the inner surface thereof, and an emissive material 4 is adhered to the pair of electrodes 2, 2.

Besides, the glow starter according to the first embodiment, the straight-tube glow discharge lamp according to the second embodiment and the cold-cathode fluorescent lamp according to the third embodiment of the present invention may optionally include following constituents.

I. Getter

If impurity gases exist in the ionizable filling, the startability will be lowered. Thus, a performance getter for absorbing impurity gases is mounted inside the discharge vessel to eliminate the impurities.

II. Housing

A housing enfolding the discharge vessel can be used to mechanically protect a glow starter. The housing can be made of materials with required mechanical strength, such as metal, synthetic resin, or ceramics. Furthermore, in order to make the attachment and detachment of the glow starter to a socket easy, wimples which work as a slip stopper for easy knurling can be formed on the housing.

III. Bulb-base

A bulb-base can be a screw bulb-base such as the Type-E17 bulb-base or a pin bulb-base such as a Type-P21 bulb-base according to the rating of the fluorescent lamp.

Furthermore, the glow starter, the straight-tube glow discharge lamp and the cold-cathode fluorescent lamp can be modified as follows, as appropriate.

The emissive material can be made of zinc-nickel alloy at a required ratio of quantities.

This composition of the emissive material defines a specific configuration of the zinc alloy. That is, in a zinc alloy containing Ni as the other constituent, by containing about 25 mass % of Ni, zinc-nickel alloy $NiZn_3$ having a melting point of 881° C. is obtained. By containing about 19 mass % of Ni, zinc-nickel alloy $NiZn_{21}$ having a melting point of 870° C. is obtained. By containing about 11 mass % Ni, zinc-nickel alloy NiZn8 having a melting point of 790° C. is obtained. In either form of alloys, stable intermetallic compounds are obtained. In this manner, zinc-nickel alloys with a wide variety of composition ratio can be applied without departing from the concept of the present invention. The zinc-nickel alloy may be a solid solution, for instance.

In this composition, the zinc constituent of the emissive material which is made of the zinc-nickel alloy is activated so as to easily emit electrons. A primary electron emissive capability of the zinc-nickel alloy is almost equivalent to that of zinc simple substance. Thus, the discharge starting property of the glow-discharge lamp in the dark can be improved.

Furthermore, since the emissive material is made of zinc-nickel alloy, the melting point of the emissive material elevates. So that, the sputtering is remarkably suppressed, and the problem that the discharge starting property is deteriorated as the electron emissive material is exhausted is also improved remarkably. Furthermore, the amount of impurity gases released from the zinc-nickel alloy decreases in compared to zinc simple substance used as the emissive material. Therefore, the electron emissive operation by the zinc-nickel alloy is preserved favorably during the life performance, and the life-time of the glow-discharge lamp becomes longer.

Furthermore, since the zinc-nickel alloy is available on an industrial scale, it is able to provide the glow-discharge lamp equipped with an inexpensive emissive material.

Moreover, since the zinc-nickel alloy has a high melting point, the sputtering of the zinc-nickel alloy is suppressed and the release of the gas occluded in the zinc-nickel alloy is reduced. Furthermore, since the zinc-nickel alloy has a high current efficiency in a plating process, a very small amount of hydrogen is generated at the time of plating, and impurity gases occluded into the zinc-nickel alloy are low.

Optimally, in the zinc-nickel alloy emissive material the nickel constituent may be in the range of 2 to 15 mass %.

The above composition defines an optimal composition ratio of the zinc-nickel alloy. That is, by the nickel constituent being in the above-mentioned range a zinc-nickel alloy having a melting point in the range of 550 to 830° C. can be obtained. As being apparent that the melting point of zinc simple substance is 419.4° C., this modification of the zinc-nickel alloy has a sufficiently high melting point. Accordingly, this configuration of the glow discharge lamp has a sufficiently high sputtering resistance as compared with the glow-discharge lamp which has a zinc simple substance as the emissive material. Here, if the content of Ni is less than 2 mass %, the melting point decreases excessively. On the other hand, even if the content of Ni exceeds 15 mass %, the melting point becomes hardly rise.

The zinc-nickel alloy with the above-mentioned composition ratio can be directly formed in film shape on the electrode according to the eutectoid electroplating. Therefore, it will be easy to place the emissive material. Here, the zinc-nickel alloy in the above-mentioned composition ratio is able to be formed by a hot-dip plating for instance.

Since the zinc-nickel alloy in the above-mentioned composition ratio contains much zinc a lot, it has sufficient electron emissive capability.

The zinc alloy emissive material may be a ternary zinc alloy comprised of zinc and two kinds of metal selected from a group of cobalt, copper, nickel, tin, and molybdenum.

This composition defines a glow-discharge lamp wherein the emissive material is a ternary zinc alloy. The ternary zinc alloy may for example be Zn—Co—Mo, Zn—Co—Cr, or Zn—Nil—Co. The Zn—Co—Mo has a composition ratio, i.e., Co of 1 to 3 mass %, Mo of 0.1 to 0.5 mass %, and Zn of residue. The Zn—Co—Cr has a composition ratio, i.e., Co of about 0.1 to 0.5 mass % (e.g., 0.3 mass %), Cr of 0.01 to 0.1 mass % (e.g., 0.05 mass %), and Zn of residue. The Zn—Ni—Co has a composition ratio, i.e., Ni of 15 to 20 mass % (e.g., 17 mass %), Co of 0.1 to 0.5 mass % (e.g., 0.3 mass %), and Zn of residue. These ternary zinc alloys may be formed in a film shape directly on the electrode according to the eutectoid electroplating for instance.

In this composition, the ternary zinc alloy as for the zinc alloy works almost the same in operation and effect as the binary zinc alloy.

The emissive material may be comprised of a zinc-nickel alloy and a metal with a work function of 4 eV or less, and a melting point equal to or more than 500° C.

This composition defines a discharge lamp which is provided with the emissive material containing the zinc-nickel alloy and metal(s) or alloy(s) which satisfy the above-mentioned conditions. The metal(s) or alloy(s) satisfying the conditions may be one or plurality of Mg, Ca, Sr, Ba, Sc, Y, La, Zr, Hf, Th, and Ce. In addition, the phrase "metal with a work function of 4 eV or less, and a melting point equal to or more than 500° C. "means that the metal includes an alloy of such a metal and a zinc-nickel alloy. Here, La may create a chemical compound with B.

Furthermore, the composition ratio of the zinc-nickel alloy and other metal satisfying the above-mentioned conditions is arbitrary. Therefore, either of them may be plenty in content.

In this composition, since the zinc-nickel alloy is contained in the emissive material, an excellent operation and effect of the zinc-nickel alloy and the same of the other metal are concurrently obtained.

The emissive material may be adhered to the electrode via a foundation layer.

The foundation layer works to inhibit an interference between the construction materials of the electrode and the emissive material.

In this configuration, the electrode to be provided with the emissive material, for instance, the zinc-alloy may be either of a movable electrode and a fixed electrode. The foundation layer is especially more effective for the aspect wherein the zinc alloy is provided on the movable electrode with a Mn—Cu—Ni alloy as one element of the bimetal. This is because that, if the foundation layer does not exist, the bimetal is easily deteriorated by a chemical reaction between Mn and zinc alloy. The bimetal deteriorates more remarkably when the zinc alloy is formed by electroplating. Here, this configuration is also effective to the movable electrode using an Ni—Mn—Fe alloy, an Ni—Cr—Fe alloy, or a Cr—Cu—Ni alloy for one element of the bimetal.

The emissive material may be formed by electroplating at a current density of 1 to 15 A/dm$^2$.

This configuration defines the glow discharge lamp comprising zinc which is decreased the amount of hydrogen released therefrom. In glow-discharge lamps with small volume of internal space such as glow starters, gaseous impurity such as $H_2$ or $H_2O$ released from metal such as the emissive material affects lamp characteristics of the glow-discharge lamp with relative strong. Accordingly, it is necessary to decrease the amount of gas released as much as possible.

However, it is found that the current density at the plating time has much effect to a property of releasing hydrogen, even though zinc or a zinc alloy is electroplated. That is, in the glow discharge lamp electrodes having emissive material principally made of zinc being electroplated thereon at a high current density is provided, the discharge delay is occurred after the initial operation stage. This is because that if the current density at the electroplating time is high, although the plating speed increases, an eduction efficiency drops, the texture of the plated zinc alloy becomes coarse, and the amount of hydrogen occluded in the zinc alloy increases. Therefore, when operating glow-discharge lamps, it is supposed that the discharge starting voltage elevates to cause a discharge delay due to that a large amount of hydrogen is released from the zinc alloy film.

The texture of the emissive material principally made of zinc, which is electroplated at the above-described range of the current density becomes precise and reduced hydrogen occluded therein. Especially, the occluded hydrogen can be positively suppressed by making the emissive material layer to have the thickness of 1.0 to 10 $\mu$m. When the thickness of the emissive material exceeds 10 $\mu$m, the absolute magnitude of the occluded hydrogen in the emissive material becomes higher, and the discharge starting voltage elevates during the life performance. Thus, in glow discharge lamps in which emissive material occluding therein a small amount of hydrogen is provided, an amount of hydrogen released is decreased to a practically permissible level during the life performance. Furthermore, if the current density is within the limit, the precipitation efficiency of the zinc alloy is sufficient, so that it is suited to the industrial production. Here, a preferable range of the current density is 1 to 10 A/dm$^2$, while the optimum current density is about 5 A/dm$^2$.

In addition, if the current density at the electroplating time exceeds 15 A/dm$^2$, the productive efficiency of the electroplating will be improved. However, the texture of the zinc alloy will become too coarse, and an amount of hydrogen released will remarkably increase. Accordingly, such a high current density is unfavorable for glow-discharge lamps with small volume of internal space such as glow starters, because an amount of hydrogen released departs from an allowable range. On the other hand, a current density less than 1 A/dm$^2$ is also unfavorable since, although the texture of the zinc alloy becomes precise, the production efficiency is lowered to an impractical level and below.

Accordingly, this configuration is suitable for glow-discharge lamps in which there are a very small amount of hydrogen released and the discharge delay is hardly occurred during the life performance.

The emissive material principally made of zinc may occlude therein hydrogen in a range of 0.1 to 50 PPM.

Due to that the efficiency for electroplating zinc simple substance is low, an amount of hydrogen occluded in the plated zinc occasionally becomes to 100 PPM. However, it is found that the amount of the occluded hydrogen gas can be suppressed to some extent by adjusting the current density at the electroplating as described above, or employing optimal plating material. Especially, when the emissive material is zinc-nickel alloy, an amount of hydrogen occluded thereinto in the electroplating process can be reduced. This is because an allow containing nickel has a higher plating efficiency.

Glow discharge lamps such as glow starters accompany a drawback that the more the amount of hydrogen released, the higher the discharge starting voltage becomes, as mentioned before. It is practically fine if the hydrogen occlusion amount on the electroplated electrode is less than 50 PPM. Furthermore, since it is difficult to suppress the hydrogen occlusion amount less than 0.1 PPM in manufacturing, it is preferable that the hydrogen occlusion amount is 0.1 to 50 PPM. Here, its more suitable amount is 0.1 to 18 PPM, while its optimum amount is 1.0 to 10 PPM. Here, the hydrogen occlusion amount is represented by the ratio of the mass of hydrogen ($\mu$g) to the total mass (g) of the electrode and the emissive material adhered thereon, while it is presented in a unit of PPM.

The concentration of occluded gas in electrodes with zinc films adhered thereon was measured as follows. First, prepared samples wherein a zinc film with thickness of 0.1 to 10 $\mu$m was electroplated on a fixed electrode at a current density from 1 to 10 A/dm$^2$. Then, their occluded gas concentrations were sought by conducting weight conversions using the TDS absolute determination method. On these occasions, the samples were heated till the temperature rose up to 800° C. from a room temperature (about 25° C.) so as to detect the mass of hydrogen gas released from the samples. In a zinc-nickel alloy containing nickel of 2 to 15 mass %, the hydrogen occlusion amount (concentration) was 1.70 PPM. On the other hand, in a zinc film made of zinc simple substance, the hydrogen occlusion amount (concentration) was 2.78 PPM. Therefore, it was verified that the hydrogen gas released from the zinc film could be suppressed to a predetermined amount, and thus also verified that the electrode with zinc film adhered thereon was suitable for glow starters.

Furthermore, the hydrogen occlusion amount in the zinc film as the emissive material is desirable to be in the range of 10 to 300 PPM.

This range of the hydrogen occlusion amount is particularly suitable for glow starters, since the amount of hydrogen released therefrom is scarce and thus a rise of the starting voltage is also suppressed.

The ionizable filling may contain hydrogen of 0.05 to 10%.

This composition defines an optimal ionizable filling for glow discharge lamps. In general, when hydrogen is contained in the ionizable filling, a discharge delay is occurred, and thus the discharge starting voltage elevates, as mentioned before. However, the rise of the discharge starting voltage due to hydrogen contained in the ionizable filling may yield a favorable result in such a situation that restarting voltage is excessively low. For instance, when the ionizable filling is a mixed gas of neon and xenon, the restarting voltage tends to lower, and sometimes becomes below a specification during the life performance.

According to the above content of hydrogen, the restarting voltage can be limited within a suitable range. A favorable amount of hydrogen contained in the ionizable filling is 0.1 to 10%, while the optimal amount thereof is 0.05 to 5%. The content of hydrogen in the ionizable filling can also be measured by a mass spectrometer. Furthermore, if getter is provided in the discharge vessel hydrogen released from the zinc alloy during the life performance is absorbed by the getter. However, hydrogen occluded in the emissive material or zinc alloy is released little by little to compensate a decrement of hydrogen, as mentioned before. Regarding the electrode with zinc alloy adhered thereto in advance, an adequate hydrogen occlusion amount is 0.1 to 50 PPM (i.e., 0.1 to 50 $\mu$g per one gram of electrode) for electrodes is suitable to the electrode with zinc alloy adhered thereto prior fixing the electrode in the discharge vessel. The pressure of hydrogen in the ionizable filling is preferably in the range of 0.016 to 1.8 torr/cm$^3$ when representing by the partial pressure per internal volume of the discharge vessel.

A getter for absorbing impurity gases may be provided in interior of a light transparent discharge vessel.

As a getter, Ba, an alloy of Ba, a chemical compound of Ba, Zr, Al, or an alloy of Zr and Al are suitable. As an alloy of Ba, for instance, $BaAl_4$ is desirable. As a chemical compound of Ba, BaN6 (barium azide) is desirable. If $BaAl_4$ or $BaN_6$ are flashed in the discharge vessel, Ba simple substance will be liberated to perform the getter operation. As an alloy of Zr and Al, ZrAl is desirable. In addition, $BaO_2$ (barium peroxide) can also be arranged especially as a hydrogen getter.

Moreover, the getter may be fixed on the electrode by shaping it in a ring or a plate form. The getter in the form of powders may also be adhered to the stem or the discharge vessel in film form.

Therefore, in this configuration, the getter may effectively eliminates by absorbing even few impurity gases released into the interior of the discharge vessel from the zinc alloy of the emissive material during the life performance. Furthermore, the getter effectively absorbs and eliminates impurity gases such as $H_2O$ released from the wall surface of the light transparent discharge vessel. Thus, the discharge starting property of the discharge lamp can be effectively suppressed lowering thereof during the life performance.

A zinc alloy film may be formed on at least a part of the inner surface of a discharge space enclosing article. Here, the term "discharge space enclosing article" contains the discharge vessel and the stem.

This configuration defines a suitable configuration of getter for absorbing and eliminating impurities.

The zinc alloy film has a same configuration as the zinc alloy as the emissive material formed on the electrode. In order to form the zinc alloy film inside the discharge space enclosing article, a glow discharge lamp is fabricated first. Then it is sufficient to make sputtering the substance of the zinc alloy formed on the electrode towards the inner surface of the discharge vessel by conducting electric current during an aging process. Here, the electrode mount can be provided on the discharge vessel, after preforming the zinc alloy film on the inner surface of the discharge vessel or the surface of the stem.

The zinc alloy film is accepted to be an oxide.

In this configuration, the zinc alloy film formed on the inner surface of the enclosure with a wide surface effective in an impurity absorbing action, i.e., a getter action. Accordingly this aspect is able to purify the interior space of the discharge vessel by absorbing the released impurity gases such as $H_2O$ or $H_2$ in the interior space of the discharge vessel. Thus, this aspect can prevent an undesirable discharge delay or a rise of the discharge starting voltage.

The ionizable filling may contain hydrogen of 0.05 to 10%. Here, a suitable range of hydrogen is 0.05 to 5%.

This composition defines the content of hydrogen in the ionizable filling so as that the characteristics of the glow-discharge lamp fall within desirable range. In general, when hydrogen is contained in the ionizable filling, a discharge delay is occurred, and thus the discharge starting voltage elevates. However, the rise of the discharge starting voltage due to hydrogen contained in the ionizable filling improves a situation that restarting voltage is excessively low. For instance, when the ionizable filling is a mixed gas of neon and xenon, the restarting voltage tends to lower, and sometimes becomes below a specification during the life performance.

This configuration of the glow starter is able to limit the restarting voltage within a predetermined range due to the above content of hydrogen. The content of hydrogen in the ionizable filling can be measured by a mass spectrometer. Furthermore, if getter is provided in the discharge vessel hydrogen released from the zinc alloy during the life performance is absorbed by the getter. However, hydrogen occluded in the emissive material or zinc alloy is released little by little to compensate a decrement of hydrogen. Regarding the electrode with zinc alloy adhered thereto in advance, an adequate hydrogen occlusion amount is 0.1 to 50 PPM (i.e., 0.1 to 50 $\mu$g per one gram of electrode) for electrodes is suitable to the electrode with zinc alloy adhered thereto prior fixing the electrode in the discharge vessel.

The emissive material may be provided on the movable electrode.

This configuration is preferable to glow starters. The emissive material may be provided on either or both of the bimetal of the movable electrode and a weld (e.g., a metal rod 3*a* shown in FIG. 2) for supporting the bimetal. Either or both of the electrodes may be movable electrodes. In case of both electrodes being movable electrodes, the emissive material may be provided on either or both of these movable electrodes.

In this configuration, by trying the emissive material be fit on a relatively large-sized movable electrode, a desired amount of the emissive material can easily be fit thereon.

The emissive material may be fit directly on the fixed electrode.

This configuration differs from the last configuration by that the emissive material is provided on the fixed electrode. The emissive material is able to obtain the desired operation and effect, even if the emissive material is adhered to the fixed electrode. Since the fixed electrode where there are few restrictions to electrode material, any material which is hard to react with the zinc alloy can be selected. Therefore, this aspect does not need a foundation layer. Therefore, this aspect can be easily fabricated, and its cost can be suppressed. Furthermore, since the fixed electrode where there are few restrictions to the shape of the fixed electrode and it is not deformed, the emissive material is easy to be fit thereon.

The ionizable filling may contain 1 to 40% of neon, krypton and/or xenon to argon.

This composition defines a suitable composition ratio of neon, krypton and/or xenon to argon. That is, if the composition pressure ratio of krypton and/or xenon is 1% or less, the action of lowering the discharge starting voltage is insufficient. On the other hand, if the composition pressure ratio exceeds 40%, the discharge starting voltage excessively drops.

At least one of the electrodes is a movable electrode having a bimetal, and then it becomes possible that an emissive material is adhered to the bimetal.

This configuration defines the glow starter. By making the emissive material be adhered to the bimetal, it becomes easy to adhere a required amount of the emissive material.

On the other hand, one of the electrodes is a fixed electrode, and then it becomes possible that an emissive material is adhered to the fixed electrode.

The ionizable filling may be mixed gas of neon (Ne) and at least one of krypton (Kr), xenon (Xe), and argon (Ar) at a partial pressure ratio in the range of 0.1 to 60%.

The partial pressure ratio of the at least one of the krypton, xenon, and argon is defined in the range from 0.1 to 60% according to relations to the discharge starting voltage, the restarting voltage, the total pressure of the ionizable filling, etc. The partial pressure is preferably in the range of 0.14 to 40%, while it is optimally in the range of 3 to 20%. Here, when some amount of gas including at least one of krypton, xenon, or argon is required, its pressure ratio may be defined in the rage of 2 to 60%.

In this composition, since a desirable discharge starting voltage is obtained by optimizing the partial pressure ratio of the mixed gas of the ionizable filling, more reliable startability can be obtained. Accordingly, the lowering of the restarting voltage is suppressed during the life performance, so that it is operated stably during the life performance.

Still another aspect of the present invention can provide an electrode for glow starters, glow discharge lamps or cold-cathode fluorescent lamps, which is provided with emissive material containing a zinc alloy adhered thereto at a portion to be fixed in a discharge vessel of the glow starters, the glow discharge lamps or the cold-cathode fluorescent lamps.

This aspect of invention defines a configuration effective as the electrode of such glow starters, glow discharge lamps or cold-cathode fluorescent lamps.

By fitting this aspect of electrode for glow discharge lamps in the discharge vessel, the discharge starting time is shortened and thus the discharge starting property in the dark is improved. In the same manner, the sputtering of the emissive material is remarkably improved, and the impurity gases released from the zinc alloy is reduced. Accordingly, a longer lasting glow discharge lamp can be obtained.

Figure 21:
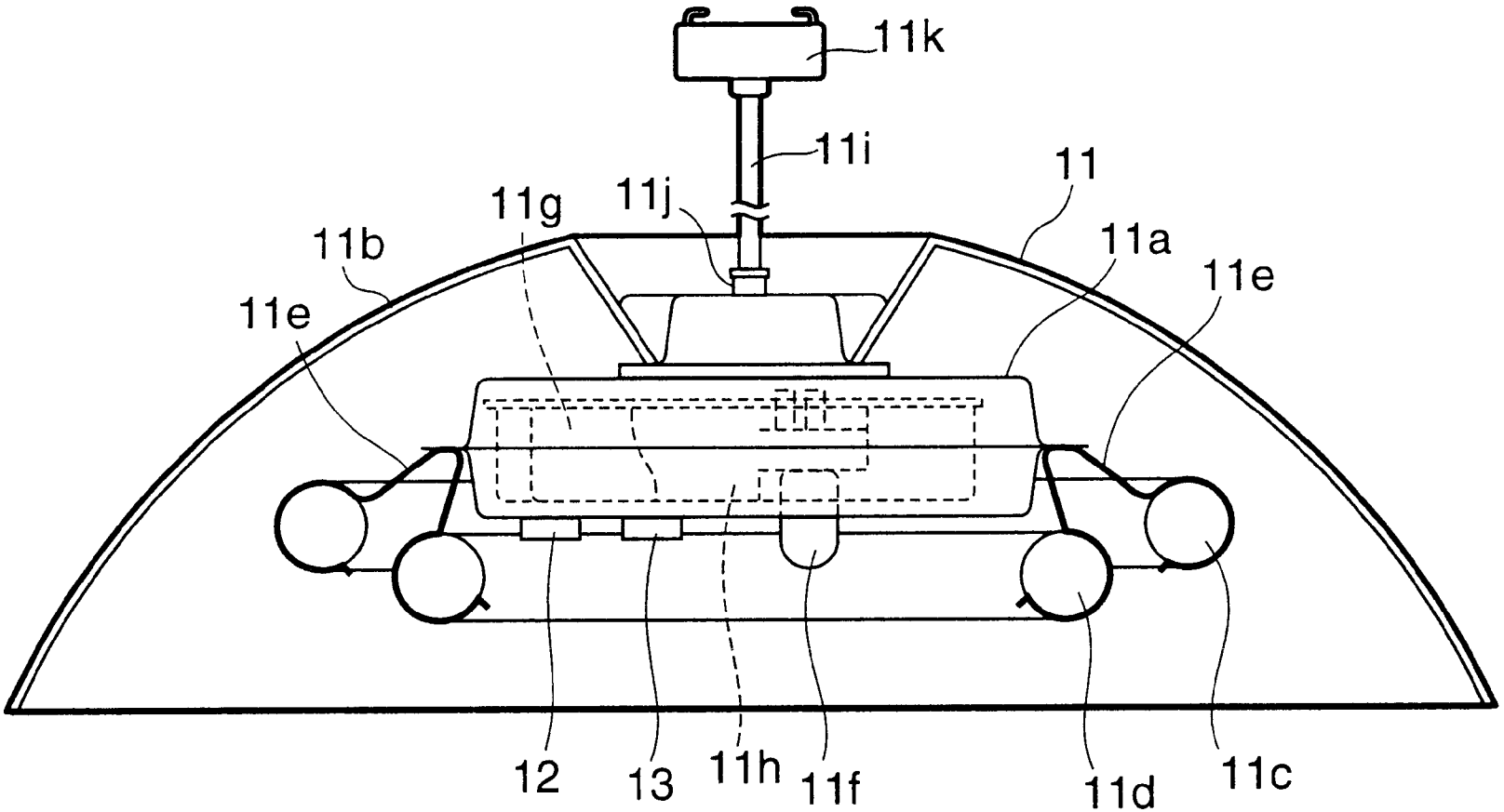
FIG. 21 is a section showing a pendant type luminaire according to another embodiment of the present invention.

Referring now to FIG. 21, a pendant type luminaire according to another embodiment of the present invention will be described.

The luminaire comprises a luminaire main body 11 and the glow starters 12, 13 having a configuration according to any one of the first to third aspects, which are mounted on the luminaire main body 11.

The luminaire main body 11 is provided with a chassis 11*a*, a shade 11*b*, fluorescent lamps 11*c*, lid, a lamp holder 11*e*, a night light 11*f*, a ballast 11*g*, a changeover switch 11*h*, a pendant cord 11*i*, a cord holder 11*j*, and a hook ceiling cap 11*k*. The chassis 11*a* accommodates therein the ballast 11*g* and the changeover switch 11*h*. The chassis 11*a* holds the lamp holder 11*j* on their edge, and also holds the shade 11*b* on their upper surface. The fluorescent lamps 11*c*, 11*d* are supported on the chassis 11*a* via the lamp holder 11*e*. The night light 11*f* is exposed from the bottom surface of the chassis 11*a*. The pendant cord 11*i* is lead out from the upper surface of the chassis 11*a* via the cord holder 11*j*. The cord holder 11*j* makes the length of the pendant cord 11*i* be adjustable. The hook ceiling cap 11*k*, which is provided on the nose end of the pendant cord 11*i*, is electrically coupled and mechanically supported to the hook ceiling body that is provided on the ceiling in the room, so that the luminaire main body 11 is hung from the ceiling.

The glow starters 12, 13 are detachably mounted in the chassis 11*a*, while their head portions are exposed outside from the chassis 11*a*.

In this aspect, the term "luminaire main body" designates the whole portion of the luminaire except the glow discharge lamp. Therefore, the discharge lamp and the discharge lamp lighting system may be or may not be included in the luminaire main body. The luminaire is not limited their application and configuration. When the glow discharge lamp specifically means a glow starter, a fluorescent lamp etc., is mounted on the luminaire main body. Then, the glow starter makes the fluorescent lamp start to light. When the glow discharge lamp specifically means a glow discharge lamp for display units, the specific glow discharge lamp for display units itself works as a lighting source.

One aspect of the present invention is able to provide a glow discharge lamp wherein it is comprised of a discharge vessel, a pair of electrodes, ionizable filling, and an emissive material principally made of a zinc film with 1.0 to 10 $\mu$m thickness adhered to at least one of the electrodes, and wherein a discharge starting time is shortened and a discharge starting property in the dark is improved.

Another aspect of the preset invention is able to provide a glow discharge lamp wherein emissive material is made of the zinc-nickel alloy thus improving a discharge starting property in the dark, zinc activates thus facilitating emission of electrons and then improving a discharge starting property in the dark, a melting point of the emissive material elevates thus remarkably reducing sputtering of substance of the emissive material and suppressing deterioration of lamp characteristics due to exhaust of the emissive material, impurity gases released from the emissive material is reduced thus improving the lamp life, and the zinc-nickel alloy is available on an industrial scale and inexpensive.

Still another aspect of the present invention is able to provide a glow discharge lamp wherein ionizable filling contains 1 to 40% of neon, krypton and/or xenon to argon, and thus it is able to contains a favorable composition ratio of neon, krypton and/or xenon to argon.

Further aspect of the present invention is able to provide a glow starter, wherein at least one of electrodes is comprised of a movable electrode having a bimetal, the electrodes are thus touchable to each other through the deformation of the bimetal due to heat of the glow discharge, and emissive material is adhered to the bimetal, and thus it is easy to adhere a required amount of emissive material.

Still further aspect of the present invention is able to provide a glow starter wherein at least one electrode is a movable electrode having a bimetal, the other electrode is a fixed electrode, emissive material is adhered to the fixed electrode, and the emissive material thus can be directly adhered to the fixed electrode.

Still further aspect of the present invention is able to provide a glow discharge lamp wherein an amount of hydrogen is scarcely released, and the discharge delay is hardly occurred during the life performance.

Still further aspect of the present invention is able to provide a glow starter wherein an amount of hydrogen released during operation of the glow discharge lamp is reduced, and an undesirable rise of the discharge starting voltage is inhibited.

Still further aspect of the present invention is able to provide a glow discharge lamp wherein it is comprised of a discharge vessel, a pair of electrodes, ionizable filling, and an emissive material containing zinc alloy adhered on at least one electrode, and wherein a discharge starting time is shortened, a discharge starting property in the dark is improved, sputtering of substance of the emissive material is remarkably improved, and an amount of impurity gases released from the zinc alloy is reduced thus improving the lamp life.

Still further aspect of the present invention is able to provide a glow discharge lamp wherein emissive material is made of the zinc-nickel alloy which is easily available on an industrial scale and inexpensive.

According to still another aspect of the present invention, it is able to provide a glow discharge lamp wherein emissive material is a zinc-nickel alloy containing 2 to 15 mass % of nickel, thus having a high melting point, being capable of forming a film directly on the electrode by e.g., an eutectoid electroplating, easy to place, and having a sufficient electron emissive capability.

Still further aspect of the present invention is able to provide a glow discharge lamp which is provided with a ternary zinc alloy comprised of zinc and two kinds of metals selected from a group of cobalt, copper, nickel, tin, and molybdenum, and thus presents almost same effect obtained by a binary zinc alloy.

Still further aspect of the present invention is able to provide a glow discharge lamp which is provided with emissive material made of a zinc-nickel alloy and metal having a work function of 4 eV or less, and a melting point of 500° C. or more, and thus concurrently yielding excellent action and effect of the zinc alloy and the same of the other metal.

Still further aspect of the present invention is able to provide a glow discharge lamp which is provided with emissive material adhered to an electrode via a foundation layer, and thus inhibits an interference between the electrode and the emissive material.

Still further aspect of the present invention is able to provide a glow discharge lamp wherein zinc alloy is formed by electroplating at a current density of 1 to 15 $A/dm^2$, hydrogen is scarcely released from the zinc alloy, and a discharge delay is hardly occurred during the life performance.

Still further aspect of the present invention is able to provide a glow starter wherein zinc-nickel alloy is electroplated on an electrode, the zinc-nickel alloy contains hydrogen occluded therein in an amount of 0.1 to 50 PPM, an amount of the hydrogen released during operation is thus reduced, and an undesirable rise of the discharge starting voltage is inhibited.

Still further aspect of the present invention is able to provide a glow discharge lamp wherein getter is provided in a light-transparent discharge vessel, the getter thus absorbs and eliminates impurity gases released from zinc alloy of emissive material during the life performance, and a lowering of the discharge starting property during the life performance is inhibited.

Still further aspect of the present invention is able to provide a glow discharge lamp wherein a zinc alloy film having a wide surface effective in an impurity absorbing action, i.e., a getter action is provided inside a discharge vessel, thus the zinc alloy film purifying the interior space of the discharge vessel, preventing an undesirable discharge delay and a rise of discharge starting voltage.

Still further aspect of the present invention is able to provide a glow discharge lamp wherein ionizable filling contains 0.05 to 5% of hydrogen, a tendency of lowering a restarting voltage is thus offset, and a restarting voltage falls in a predetermined range at all times.

Still further aspect of the present invention is able to provide a glow starter wherein at least one electrode is a movable electrode having a bimetal, a pair of electrodes are thus touchable to each other by deformation of the bimetal caused by heat generated in a glow discharge, and a required amount of emissive material can be adhered on the bimetal of the movable electrode.

Still further aspect of the present invention is able to provide a glow discharge lamp wherein one electrode is a movable electrode having a bimetal and the other electrode is a fixed electrode, a pair of electrodes are thus touchable to each other by deformation of the bimetal caused by heat generated in a glow discharge, emissive material is directly adhered to the fixed electrode, and thus it is easy to fabricate and inexpensive in cost.

Still further aspect of the present invention is able to provide a glow starter wherein emissive material containing zinc is provided on an electrode, optimal mixed gas is filled as ionizable filling, and thus a required operation time property is preserved, a discharge starting voltage is reduced, a lowering of restarting voltage is inhibited during the life performance, and thus it is able to stably operate during the lighting operation. Furthermore, in the aspect sputtering is inhibited and thus a long life-time is achieved.

Still further aspect of the present invention is able to provide a glow discharge lamp wherein a partial pressure ratio of a mixed gas as ionizable filling is optimized, and thus it is able to provide a glow discharge lamp wherein a discharge operation is able to definitely start, a lowering of restarting voltage is inhibited during the life performance, and thus it is able to more stably operate during the lighting operation.

Still further aspect of the present invention is able to provide a glow discharge lamp having emissive material which is inexpensive and easily available on an industrial scale.

Still further aspect of the present invention is able to provide a glow starter wherein emissive material is a zinc-nickel alloy containing 2 to 15 mass % of nickel, thus having a high melting point, being capable of forming a film directly on the electrode by e.g., an eutectoid electroplating, easy to place, and having a sufficient electron emissive capability.

Still further aspect of the present invention is able to provide luminaire wherein it is comprised of a luminaire main body and the glow discharge lamp according to any one of the above aspects of the invention which is applicable to the luminaire main body, thus capable of exerting the operation and the effect of the glow discharge lamp according to the above aspects of the invention.

Still further aspect of the present invention is able to provide a glow discharge lamp wherein emissive material containing zinc alloy is placed on an electrode at a portion fixed in a discharge lamp in which ionizable filling is filled, a discharge starting time is shortened and a discharge starting property in the dark is improved, sputtering of substance of the emissive material is remarkably improved, and an amount of impurity gases released from the zinc alloy is reduced thus improving the lamp life.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

The foregoing description and the drawings are regarded by the applicant as including a variety of individually inventive concepts, some of which may lie partially or wholly outside the scope of some or all of the following claims. The fact that the applicant has chosen at the time of filing of the present application to restrict the claimed scope of protection in accordance with the following claims is not to be taken as a disclaimer or alternative inventive concepts that are included in the contents of the application and could be defined by claims differing in scope from the following claims, which different claims may be adopted subsequently during prosecution, e.g., for the purposes of a divisional application.

What is claimed is:

1. A glow discharge lamp, comprising:

a discharge vessel;

a pair of electrodes mounted in the discharge vessel;

ionizable filling which is principally made of rare gas and filled in the discharge vessel; and emissive material containing zinc alloy and provided on at least one of the electrodes.

2. A glow discharge lamp as claimed in claim 1, wherein the zinc alloy is zinc-nickel alloy.

3. A glow discharge lamp as claimed in claim 2, wherein the zinc-nickel alloy contains 15 mass % of nickel.

4. A glow discharge lamp claimed in claim 1, wherein the zinc alloy is ternary zinc alloy principally made of two metals selected from a group of zinc, cobalt, copper, nickel, tin, and molybdenum.

5. A glow discharge lamp claimed in claim 1, wherein the emissive material is made of zinc-nickel alloy and metal whose work function is 4 eV or less, and whose melting point is more than 500° C.

6. A glow discharge lamp as claimed in claim 1, wherein the emissive material is provided on at least one electrode via a foundation layer.

7. A glow discharge lamp as claimed in claim 1, wherein the zinc alloy is electroplated at a current density of 1 to 15 $A/dm^2$.

8. A glow discharge lamp as claimed in claim 1, wherein the zinc alloy is zinc-nickel alloy, whose hydrogen occlusion amount in pressure is in a range of 0.1 to 50 PPM.

9. A glow discharge lamp as claimed in claim 1, wherein getter is provided in the discharge vessel.

10. A glow lamp as claimed in claim 1, wherein the ionizable filling is principally made of mixed gas of a first gas comprising neon and a second gas comprising at least one of krypton, xenon, and argon.

11. A glow discharge lamp as claimed in claim 10, wherein the second gas has a partial pressure ratio of 0.1 to 60, and the first gas for the residue.

12. A glow discharge lamp as claimed in claim 1, wherein the ionizable filling contains 0.01 to 10% of hydrogen.

13. A glow discharge lamp as claimed in claim 1, wherein at least one of the electrodes is a movable electrode provided with the bimetal, and the electrode are touchable to each other by deformation of the bimetal caused by heat generated in a glow discharge, and wherein the emissive material is adhered on the movable bimetal.

14. A glow discharge lamp claimed in claim 1, wherein one of the electrodes is a movable electrode provided with the bimetal, the other electrode is a fixed electrode, and the movable electrode is touchable to the fixed electrode by deformation of the bimetal caused by heat generated in a glow discharge, and wherein the emissive material is directly adhered to the fixed electrode.

15. A glow discharge lamp as claimed in claims 1, wherein a zinc alloy film is formed inside the discharge vessel.

16. A luminaire, comprising;

a luminaire main body;

a glow discharge lamp as claimed in claim 1, which is mounted to the luminaire main body; and a fluorescent lamp mounted to the luminaire main body.

17. An electrode for glow discharge lamp, wherein emissive material containing zinc alloy is placed on an electrode at a portion fixed in a discharge lamp in which ionizable filling is filled.

18. A glow discharge lamp, comprising:

a discharge vessel;

a pair of electrodes mounted in the discharge vessel;

ionizable filling which is principally made of rare gas filled in the discharge vessel; and emissive material provided on at least one of the electrodes, and principally made of zinc in thickness of 1.0 to 20 $\mu$m.

19. A glow discharge lamp as claimed in claim 18, wherein the emissive material is alloy of zinc and nickel.

* * * * *